US007566521B2

(12) United States Patent
Kotsugai et al.

(10) Patent No.: US 7,566,521 B2
(45) **Date of Patent: *Jul. 28, 2009**

(54) TONER, DEVELOPER, TONER CONTAINER, PROCESS CARTRIDGE, IMAGE FORMING APPARATUS, AND IMAGE FORMING METHOD

(75) Inventors: Akihiro Kotsugai, Numazu (JP); Satoshi Mochizuki, Numazu (JP); Hisashi Nakajima, Numazu (JP); Yasuo Asahina, Numazu (JP); Osamu Uchinokura, Numazu (JP); Masayuki Ishii, Numazu (JP); Tomoyuki Ichikawa, Kawasaki (JP); Shinya Nakayama, Numazu (JP); Koichi Sakata, Numazu (JP); Tomoko Utsumi, Ebina (JP); Hitoshi Iwatsuki, Numazu (JP); Yasuaki Iwamoto, Numazu (JP); Hideki Sugiura, Fuji (JP); Masami Tomita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 41 days.

This patent is subject to a terminal disclaimer.

(21) Appl. No.: 11/777,424

(22) Filed: Jul. 13, 2007

(65) Prior Publication Data

US 2008/0014527 A1 Jan. 17, 2008

Related U.S. Application Data

(60) Division of application No. 11/498,138, filed on Aug. 3, 2006, now Pat. No. 7,318,989, which is a continuation of application No. PCT/JP2005/000876, filed on Jan. 24, 2005.

(30) Foreign Application Priority Data

Feb. 3, 2004 (JP) ..... 2004-026233

(51) Int. Cl.
*G03G 15/08* (2006.01)

(52) U.S. Cl. ..... 430/123.5; 430/110.3

(58) Field of Classification Search ..... 430/120.1, 430/123.5, 110.3; 399/232, 111
See application file for complete search history.

(56) References Cited

U.S. PATENT DOCUMENTS 4,740,443 A 4/1988 Nakahara et al.

(Continued)

FOREIGN PATENT DOCUMENTS

EP 0 410 482 A2 1/1991

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner*—Christopher RoDee
(74) *Attorney, Agent, or Firm*—Oblon, Spivak, McClelland, Maier & Neustadt, P.C.

(57) ABSTRACT

To provide a toner that can provide long-term removability and high-definition images with reduced image layer thickness and densely-packed toner particles, a developer capable of forming high-quality images using the toner, a toner container for containing the toner, a process cartridge using the toner, an image forming apparatus using the toner, and an image forming method using the toner. The toner of the present invention is a toner having a substantially spherical shape with irregularities on its surface and containing at least a binder resin and a colorant, wherein a surface factor SF-1 that represents the sphericity of toner particles is 105 to 180, a surface factor SF-2 that represents the degree of surface irregularities of the toner particles is correlated with the volume-average diameter of the toner particles, and the toner particles have an inorganic oxide particle-containing layer within 1 μm from their surfaces.

16 Claims, 8 Drawing Sheets

U.S. PATENT DOCUMENTS

| | | | | |
|---|---|---|---|---|
| 5,135,832 | A | 8/1992 | Sacripante et al. | |
| 5,202,209 | A | 4/1993 | Winnik et al. | |
| 5,215,854 | A | 6/1993 | Yamazaki et al. | |
| 5,307,122 | A | 4/1994 | Ohno et al. | |
| 6,004,715 | A | 12/1999 | Suzuki et al. | |
| 7,318,989 | B2 * | 1/2008 | Kotsugai et al. | 430/109.4 |
| 2003/0152859 | A1 | 8/2003 | Emoto et al. | |
| 2006/0165989 | A1 | 7/2006 | Takikawa et al. | |

FOREIGN PATENT DOCUMENTS

| | | | |
|---|---|---|---|
| EP | 1 026 554 | A1 | 8/2000 |
| JP | 7-333887 | | 12/1995 |
| JP | 11-133666 | | 5/1999 |
| JP | 11-174731 | | 7/1999 |
| JP | 2000-162823 | | 6/2000 |
| JP | 2000-214629 | | 8/2000 |
| JP | 2000-267331 | | 9/2000 |
| JP | 2002-62685 | | 2/2002 |
| JP | 2003-131416 | | 5/2003 |
| JP | 2003-316071 | | 11/2003 |
| JP | 2005-49858 | | 2/2005 |
| WO | WO 99/23534 | | 5/1999 |
| WO | WO 2005/005522 | A1 | 1/2005 |

OTHER PUBLICATIONS

Gotoh, Keishi et al (eds.) Powder Technology Handbook, second edition. New York: Marcel-Dekker, Inc. (1997) pp. 3-15.*

U.S. Appl. No. 12/110,055, filed Apr. 25, 2008, Sakata, et al.

U.S. Appl. No. 12/252,693, filed Oct. 16, 2008, Sakata.

U.S. Appl. No. 12/297,952, filed Oct. 21, 2008, Iwamoto, et al.

U.S. Appl. No. 12/203,278, filed Sep. 3, 2008, Yamada, et al.

U.S. Appl. No. 12/209,583, filed Sep. 12, 2008, Seshita, et al.

Aoki, T., "Chemical Toner Technology and The Future", IS&T's NIP19: International Conference on Digital Printing Technologies, pp. 2-4 (2003).

* cited by examiner

TONER, DEVELOPER, TONER CONTAINER, PROCESS CARTRIDGE, IMAGE FORMING APPARATUS, AND IMAGE FORMING METHOD

CROSS-REFERENCE TO RELATED APPLICATIONS

This is a divisional application of U.S. application Ser. No. 11/498,138, filed Aug. 3, 2006, which is a continuation of PCT/JP2005/000876, filed on Jan. 24, 2005.

BACKGROUND OF THE INVENTION

1. Field of the Invention

The present invention relates to a toner for developing a latent electrostatic image in electrophotography, electrostatic recording, electrostatic printing or the like, a developer using the toner, a toner container for containing the toner, a process cartridge using the toner, an image forming apparatus using the toner, and an image forming method using the toner.

2. Description of the Related Art

Electrophotography uses a developer to develop a latent electrostatic image formed on a latent electrostatic image bearing member. Such a developer can be classified into two types: a one-component developer consisting of toner, and a two-component developer consisting of carrier and toner. The two-component developer can provide relatively stable, excellent images by mixing carrier and toner together to allow toner particles to be positively or negatively charged.

Toner production process can be broadly divided into two general categories: dry process, and wet process. In the former process, a binder resin, a colorant, a releasing agent, etc., are melted and mixed together by heat and pressure, cooled, and pulverized into toner particles. Since this pulverization process involves smashing of toner particles into a plate by means of air pressure and collision of toner particles, finely pulverized toner particles are not spherical and have irregularities.

In the latter process, a binder resin, a colorant, a releasing agent, etc, are added to a solvent for polymerization, followed by drying to produce toner particles which are therefore spherical and have smooth surfaces.

Along the widespread use of color-image forming apparatus of recent years, small diameter toners are under study for high-definition color images.

For the production of small diameter toners, wet process is more advantageous than dry process. Wet process, however, tends to produce spherical, smooth toner particles as described above, resulting in poor removability. In particular, cleaning troubles occur frequently in the case of blade cleaning. Against this background, a number of proposals have been under study to control toner shape in wet process.

For example, Japanese Patent Application Laid-Open (JP-A) No. 11-174731 discloses a toner that comprises toner particles and an external additive and has the following characteristics: average circularity=0.920 to 0.995; weight-average particle diameter=2.0 μm to 9.0 μm; the proportion of particles with an average circularity of less than 0.950 is 2% to 40% on a number basis; and the external additive is present on the toner particles in the form of primary particles or secondary particles.

Japanese Patent Application Laid-Open (JP-A) No. 2000-214629 discloses a toner composed of toner particles, where a coefficient of variation for shape coefficient is 16% or less and a coefficient of number variation in the number-based size distribution is 27% or less.

Japanese Patent Application Laid-Open (JP-A) No. 2000-267331 discloses a toner that comprises resin particles and a colorant and satisfies is the following conditions at the same time: GSDv≦1.25, SF=125 to 140, $D_{50v}$=3 μm to 7 μm, (the proportion of particles with SF-1 of 120 or less)≦20% on a number basis, (the proportion of particles with SF-1 of 150 or greater)≦20% on a number basis and (the proportion of particles with SF-1 of 120 or less and a circle equivalent diameter of 4/5 or less)≦10% on a number basis.

Japanese Patent Application Laid-Open (JP-A) No. 2002-62685 discloses an image forming method using a toner where a coefficient of variation for shape coefficient is 16% or less, a coefficient of number variation in the number-based size distribution is 27% or less, and a toner flocculation ratio is 3% to 35%.

It is, however, difficult for the strategies disclosed in these Patent Literatures to provide high-definition images and to achieve long-term stable removability. More specifically, toner particles with specific shape factors specified by these conventional techniques cannot be removed well with a blade cleaning approach. Furthermore, there is a problem that cleaning troubles occur, particularly in a case where smaller toner particle diameters are employed along with the recent demand for high-quality images and where toner particles have smooth surfaces without irregularities.

Thus, toners that can provide long-term removability and high-definition images with reduced image layer thickness and densely-packed toner particles, and related technologies using such toners have not yet been provided.

SUMMARY OF THE INVENTION

It is an object of the present invention to solve the foregoing conventional problems and to provide a toner that can provide long-term removability and high-definition images with reduced image layer thickness and densely-packed toner particles, a developer capable of forming high-quality images by use of the toner, a toner container for containing the toner, a process cartridge using the toner, an image forming apparatus using the toner, and an image forming method using the toner.

The following is the means for solving the foregoing problems:

<1> A toner including: a toner material which comprises a binder resin and a colorant, wherein the toner has a substantially spherical shape with irregularities on its surface, and wherein a surface factor SF-1 that represents the sphericity of toner particles represented by the following Equation (1) is 105 to 180, a surface factor SF-2 that represents the degree of surface irregularities of the toner particles represented by the following Equation (2) is correlated with the volume-average diameter of the toner particles, and the toner particles have an inorganic oxide particle-containing layer within 1 μm from their surfaces.

$$\text{SF-1}=[(MXLNG)^2/\text{AREA}]\times(100\pi/4) \qquad \text{Equation (1)}$$

where MXLNG represents the maximum length across a two-dimensional projection of a toner particle, and AREA represents the area of the projection $$\text{SF-2}=[(PERI)^2/\text{AREA}]\times(100/4\pi) \qquad \text{Equation (2)}$$

where PERI represents the perimeter of a two-dimensional projection of a toner particle, and AREA represents the area of the projection <2> The toner according to <1>, wherein the SF-1 is 115 to 160 and the SF-2 is 110 to 300.

<3> The toner according to <1>, wherein the difference between the SF-2 of toner particles whose particle diameter is smaller than the most abundant toner particle diameter in a particle size distribution and the SF-2 of toner particles whose particle diameter is equal to or larger than the most abundant toner particle diameter in the particle size distribution is 8 or greater.

<4> The toner according to <1>, wherein the inorganic oxide particle-containing layer comprises silica.

<5> The toner according to <1>, wherein the volume-average particle diameter is 3 μm to 10 μm.

<6> The toner according to <1>, wherein the ratio of the volume-average particle diameter (Dv) to the number-average particle diameter (Dn), (Dv/Dn), is 1.00 to 1.35.

<7> The toner according to <1>, wherein the proportion of toner particles having a circle equivalent diameter, the diameter of a circle having the same area as the projection of toner particle, of 2 μm is 20% or less on a number basis.

<8> The toner according to <1>, wherein the porosity of the toner particles under pressure of 10 kg/cm$^2$ is 60% or less.

<9> The toner according to <1>, wherein the toner is produced by emulsifying or dispersing a toner material solution or a toner material dispersion in an aqueous medium to form toner particles.

<10> The toner according to <9>, wherein the toner material solution or toner material dispersion comprises an organic solvent, and the organic solvent is removed upon or after production of toner particles.

<11> The toner according to <9>, wherein the toner material comprises an active hydrogen group-containing compound and a polymer capable of reacting with the active hydrogen group-containing compound, and toner particles are produced by reaction of the active hydrogen group-containing compound with the polymer to produce an adhesive base material which the toner particles comprise.

<12> The toner according to <11>, wherein the toner material comprises an unmodified polyester resin and the mass ratio of the polymer capable of reacting with the active hydrogen group-containing compound to the unmodified polyester resin (polymer/unmodified polyester resin) is 5/95 to 80/20.

<13> A developer including a toner according to <1>.

<14> The developer according to <13>, wherein the developer is any one of a one-component developer and a two-component developer.

<15> A toner container including a toner according to <1>.

<16> A process cartridge including: a latent electrostatic image bearing member; and a developing unit configured to develop a latent electrostatic image formed on the latent electrostatic image bearing member by use of a toner according to <1> to form a visible image.

<17> An image forming apparatus including: a latent electrostatic image bearing member; a latent electrostatic image forming unit configured to form a latent electrostatic image on the latent electrostatic image bearing member; a developing unit configured to develop the latent electrostatic image by use of a toner according to <1> to form a visible image; a transferring unit configured to transfer the visible image to a recording medium; and a fixing unit configured to fix the transferred visible image to the recording medium.

<18> An image forming method including: forming a latent electrostatic image on a latent electrostatic image bearing member; developing the latent electrostatic image by use of a toner according to <1> to form a visible image; transferring the visible image to a recording medium; and fixing the transferred visible image to the recording medium.

The toner of the present invention is a toner that has a substantially spherical shape with irregularities on its surface and comprises a toner material comprising a binder resin and a colorant, wherein a surface factor SF-1 represented by the foregoing Equation (1) that represents the sphericity of toner particles is 105 to 180, a surface factor SF-2 represented by the foregoing Equation (2) that represents the degree of surface irregularities of the toner particles is correlated with the volume-average diameter of the toner particles, and the toner particles have an inorganic oxide particle-containing layer within 1 μm from their surfaces. Thus, it is possible a toner that can provide long-term removability and high-definition images with reduced image layer thickness and densely-packed toner particles.

The developer of the present invention comprises the toner of the present invention. Thus electrophotographical image formation using this developer can provide long-term removability and high-definition images with reduced image layer thickness and densely-packed toner particles, achieving stable formation of high-quality images with good reproducibility.

The toner container of the present invention contains therein the toner of the present invention. Thus electrophotographical image formation using the toner contained the toner container can provide long-term removability and high-quality images with excellent properties (e.g., charging and transferring properties).

The process cartridge of the present invention comprises a latent electrostatic image bearing member and a developing unit configured to develop a latent electrostatic image formed on the latent electrostatic image bearing member by use of the toner of the present invention to form a visible image. The process cartridge can be detachably attached to an image forming apparatus, features easy-to-handle and uses the toner of the present invention. Thus it offers excellent cleanability and excellent toner properties (e.g., charging and transferring properties), making it possible to provide high-quality images.

The image forming apparatus of the present invention comprises: a latent electrostatic image bearing member; a latent electrostatic image forming unit configured to form a latent electrostatic image on the latent electrostatic image bearing member; a developing unit configured to develop the latent electrostatic image by use of the toner of the present invention to form a visible image; a transferring unit configured to transfer the visible image to a recording medium; and a fixing unit configured to fix the transferred visible image to the recording medium. In the image forming apparatus the latent electrostatic image forming unit forms a latent electrostatic image on the latent electrostatic image bearing member, the transferring unit transfers a developed visible image to a recording medium, and the fixing unit fixes the transferred visible image to the recording medium. Thus it is possible to form high-quality electrophotographic images that offer excellent toner removability and excellent toner properties (e.g., charging and transferring properties).

The image forming method of the present invention comprises the steps of forming a latent electrostatic image on a latent electrostatic image bearing member; developing the latent electrostatic image by use of the toner of the present invention to form a visible image; transferring the visible image to a recording medium; and fixing the transferred visible image to the recording medium. In the latent electrostatic image forming step a latent electrostatic image is formed on a latent electrostatic image bearing member. In the transferring step a developed visible image is transferred to a recording medium. In the fixing step the transferred visible image is fixed to the recording medium. Thus it is possible to form high-quality electrophotographic images that offer excellent toner removability and excellent toner properties (e.g., charging and transferring properties).

DESCRIPTION OF THE PREFERRED EMBODIMENTS (Toner)

The toner of the present invention has a substantially spherical shape with irregularities on the surface, comprises a toner material comprising a binder resin and a colorant, and further comprises additional ingredient(s) as needed.

The shape factor SF-1, representing the sphericity of toner particle, of the toner is 105 to 180, and there is a correlation between the shape factor SF-2 that represents the degree of surface irregularities of toner particles and the volume-average particle diameter.

The shape of the toner is substantially spherical, including an oval shape. This enhances the flowability and facilitates its mixing with carrier. Moreover, unlike irregular toner particles, spherical toner particles are uniformly charged by friction with carrier and thus show a narrow charge density distribution, leading to reduced background fogging. Spherical toner particles can also realize an increased transfer ratio because they are developed and transferred in strict accordance with electrical field lines.

Figure 1:
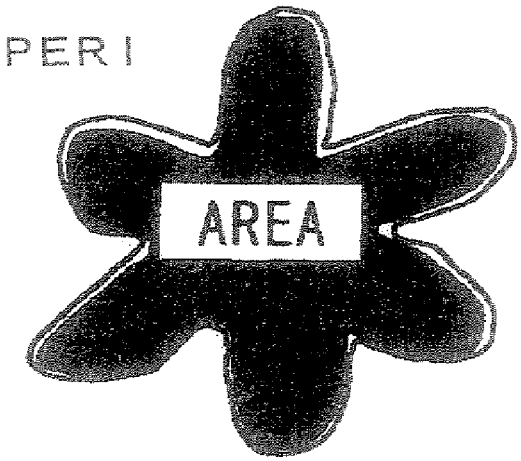
FIG. 1 is a schematic diagram of a toner particle for explaining the shape factor SF-1.

FIG. 1 is a schematic diagram of a toner particle for explaining the shape factor SF-1.

The shape factor SF-1 represents the sphericity of toner shape and is represented by the following Equation (1). SF-1 is a value obtained by dividing the square of the maximum length (MXLNG) across a two-dimensional projection of a toner particle by the projection area (AREA) and by multiplying by $100\pi/4$.

$$\text{SF-1}=[(MXLNG)^2/\text{AREA}]\times(100\pi/4) \qquad \text{Equation (1)}$$

where MXLNG represents the maximum length across a two-dimensional projection of a toner particle, and ARFA represents the area of the projection The shape factor SF-1 is 105 to 180, preferably 115 to 160 and more preferably, 120 to 150.

If the shape factor SF-1 is 100, the toner shape is a perfect sphere; the greater the shape factor SF-1, the more irregular the toner shape. If the shape factor SF-1 is greater than 180, removability is improved but the charge density distribution becomes wide, thereby resulting in increased background fogging and reduced image quality because the toner shape largely deviates from sphere. In addition, since developing and transferring of image are not conducted in strict accordance with magnetic field lines due to air drag upon transfer, the toner is developed between thin lines to result in reduced image uniformity and poor image quality. Meanwhile, even when SF-1 is 105 and thus particles are close to a perfect sphere, toners in which the volume-average particle diameter is correlated with the shape factor SF-2 can be removed even with a blade cleaning approach and can provide high-quality images because of their high image uniformity.

For a toner to be made substantially spherical, in a case of a toner produced by a dry pulverization process, it is made spherical thermally or mechanically after pulverization. For a thermal process, for example, toner particles can be made spherical by spraying them in an atomizer together with heat flow. For a mechanical process, toner particles can be made spherical by placing them into a mixer (e.g., a ball mill) for pulverization together with low specific gravity medium such as glass. Note, however, that such a thermal process entails aggregation of toner particles to form large particles and thus requires an additional classifying step for removing them, and that such a mechanical process entails generation of powder and thus similarly requires an additional classifying step for removing the powder. In addition, toners particles produced in an aqueous medium can be so controlled that their shapes range from spherical to oval, by vigorously agitating the medium in a step for removing a solvent.

The toner has irregularities on its surface. Such a toner is less adhesive to a photoconductor compared to a toner with a smooth surface, thereby increasing its removability.

Figure 2:
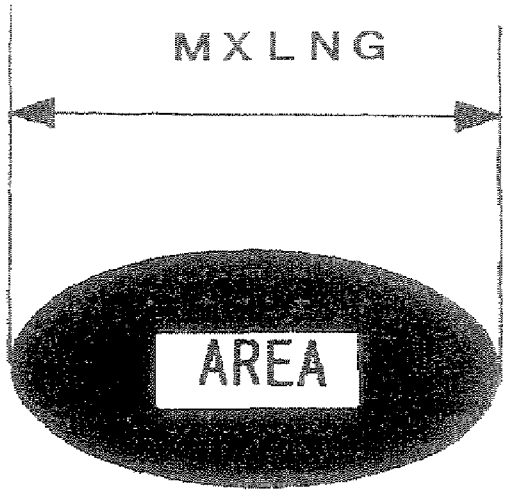
FIG. 2 is a schematic diagram of a toner particle for explaining the shape factor SF-2.

FIG. 2 is a schematic diagram of a toner particle for explaining the shape factor SF-2. The degree of surface irregularities of toner particles is represented by the shape factor SF-2 represented by the following Equation (2). SF-2 is a value obtained by dividing the square of the perimeter (PERI) of a two-dimensional projection of a toner particle by the projection area AREA) and by multiplying by $100/4\pi$.

$$\text{SF-2}=[(PERI)^2/\text{AREA}]\times(100/4\pi) \qquad \text{Equation (2)}$$

where PERI represents the perimeter of a two-dimensional projection of a toner particle, and AREA represents the area of the projection The shape factor SF-2 is 110 to 300, preferably 115 to 200 and more preferably, 118 to 150.

If SF-2 is 100, it indicates that no irregularities are present on the surface of toner; the greater the SF-2, the more conspicuous the irregularities. If SF-2 is greater than 300, removability is improved but the degree of surface irregularities of toner becomes greater and the charge density distribution becomes wider, resulting in degraded image quality because of increased background fogging. If SF-2 is 110 and thus the toner surface is smooth, toners in which the volume-average particle diameter is correlated with the shape factor SF-2 can be removed even with a blade cleaning approach and can provide high-quality images because of their narrow charge density distributions.

The shape factors SF-1 and SF-2 can be determined by, for example, using a scanning electron microscope (S-800, manufactured by Hitachi Ltd.) to take toner particle pictures and analyzing them by an image analyzer (LUSEX3, manufactured by NIRECO Corp.) using the foregoing Equations (1) and (2).

In the foregoing toner the shape factor SF-2 is correlated with the number-based particle diameter. Since both electrophotographic image uniformity and removability are influenced by toner shape and toner particle diameter, it is possible to control image uniformity and removability by correlating the number-based particle diameter with the shape factor SF-2.

As used herein "correlate" means that the shape factor SF-2 varies depending on the number-based particle diameter, meaning one of the followings relationships: (1) SF-2increases with increasing number-based particle diameter, and (2) SF-2 decreases with increasing number-based particle diameter. In view of controlling image uniformity and removability, it is preferable that the number-based particle diameter be correlated with the shape factor SF-2 in such a way that SF-2 increases with increasing number-based particle diameter.

An example of the method of correlating the number-based particle diameter with the surface factor SF-2 for a toner which has a substantially spherical shape with irregularities on the surface includes a method of changing the supply rate of a solvent stripper used in a step for causing toner surface to contract by adjusting the temperature and/or pressure, in a case where the toner is produced by dissolution suspension—one of wet processes. For example, if the number-based particle diameter is intended to be correlated with the shape factor SF-2 to a greater extent, temperature and the like may be adjusted to increase the supply rate of the solvent stripper.

Whether or not the number-based particle diameter is correlated with the shape factor SF-2 can be determined by, for example, using a scanning electron microscope (S-800, manufactured by Hitachi Ltd.) to take toner particle pictures and analyzing them by an image analyzer (LUSEX3, manufactured by NIRECO Corp.).

The volume-average particle diameter (Dv) of the toner is preferably 3 μm to 10 μm, more preferably 3 μm to 7 μm and most preferably, 3 μm to 6.5 μm. The use of toner with a volume-average particle diameter of 10 μm or less can improve reproducibility of fine lines. However, it is preferable that the volume-average particle diameter be at least 3 μm because too small volume-average particle diameter reduces developing property and removability. Moreover, if the volume-average particle diameter is less than 3 μm, the number of fine, small diameter toner particles that are less likely to be developed increases at the surface of carrier or at a developing roller, and thus the friction and contact between toner particles other than these fine particles and the developing roller or carrier may be so insufficient that the number of inversely charged toner particles increases to cause abnormalities such as background fogging, making it difficult to provide high-quality images.

The particle size distribution of the toner represented in terms of the ratio of the volume-average particle diameter (Dv) to the number-average particle diameter (Dn), (Dv/Dn), is preferably 1.00 to 1.35 and more preferably, 1.00 to 1.15. It is possible to provide a uniform toner charge density distribution by sharpening the particle size distribution. If (Dv/Dn) is greater than 1.35, the toner charge density distribution becomes too broad and the number of inversely charged toner particles increases. For these reasons, it is difficult to provide high-quality images.

The volume-average particle diameter (Dv) and the ratio (Dv/Dn) of the volume average particle diameter to the number-average particle is diameter can be determined by calculating the average of particle diameters of 50,000 toner particles using a Coulter Counter Multisizer (Beckmann Coulter Inc.) at an aperture diameter of 50 μm corresponding to the sizes of toner particles to be measured.

In addition, the difference between the SF-2 of toner particles whose particle diameter is smaller than the most abundant toner particle diameter in the particle size distribution (hereinafter may be referred to as "small diameter SF-2") and the SF-2 of toner particles whose particle diameter is equal to or larger than the most abundant toner particle diameter in the particle size distribution (hereinafter may be referred to as "large diameter SF-2"), i.e., "large diameter SF-2" minus "small diameter SF-2" is preferably 8 or greater, more preferably 12 or greater and most preferably, 20 or greater; the upper limit is preferably less than 50.

The fact that this difference is less than 8 means that toner particles whose particle diameter is smaller than the most abundant particle diameter in the particle size distribution and toner particles whose particle diameter is equal to or larger than the most abundant particle diameter in the particle size distribution have similar shapes. Thus, it may be difficult to obtain effects brought about by creating a surface factor gradient. If the difference is greater than 50, the charge density distribution becomes further broad to cause such problems as reduced image uniformity, reduced transferring property, and generation of dropouts in resultant images. In addition, while small diameter toner particles without irregularities on their surfaces are likely to slip through a cleaning blade, large diameter toner particles with many irregularities, which can provide most excellent removability, accumulate at the edge of the cleaning blade to form a "weir" that can in turn remove small diameter toner particles.

Note that for "the most abundant particle diameter in the particle size distribution," the top peak in the number-based particle size distribution is used.

Toner transfer property is associated with the state of aggregated toner particles developed on a photoconductor. A regular, flat toner layer can provide an excellent image without dropouts because both a transfer pressure and a transfer electric field are uniformly applied to the toner layer. An irregular toner layer causes dropouts and/or unevenness upon image transfer. How regular the toner layer to be developed is affected by the uniformity of the toner charge density distribution and/or the uniformity of toner flowability. To obtain such uniformity, it is preferable that the toner particles be spherical and have smooth surfaces. Small diameter toners, in particular, have this tendency and toner particles with more smooth surfaces are uniformly packed on a photoconductor with a regular surface, providing excellent transferred images. Meanwhile, once a densely packed toner layer is exposed to unusual conditions—a sight increase in transfer pressure as in the case of a transfer sheet with large irregularities (e.g., rough sheet) and/or microspace discharge upon transferring—it results in widespread reduction in transfer efficiency in comparison with irregular toners. Moreover, slight transfer unevenness tend to become manifest because of excellent average transfer ratio.

Now, it is assumed that toner particles are divided into two categories: large diameter components, and small diameter components. By creating a surface factor gradient between them, making the surfaces of the small diameter components smooth, which the small diameter components have a profound effect of improving image quality such as fine line-reproducibility and graininess, and providing large irregularities on the large diameter components, it is possible to prevent creation of an excessively densely packed toner layer while increasing the proportion of irregular toner particles in the toner layer. It is therefore possible to provide excellent toner transfer ratio and a stable toner layer.

The toner comprises an inorganic oxide particle-containing layer within 1 μm from its surface. The inorganic oxide particle-containing layer preferably occupies 60% or more of the perimeter of the toner particle when viewed end-on, and more preferably 75% or more. Most preferably, it covers the entire surface of the toner particle; however, it may appear sporadically or may form multiple layers stacked on top of each other.

It is possible to maintain a controlled toner shape by providing such an inorganic oxide particle-containing layer. If the inorganic oxide particle-containing layer is not provided within 1 μm from the toner surface, the controlled toner shape cannot be maintained. In particular, when the toner is used over time as a developer mixed and agitated with carrier, the toner shape undergoes changes due to mechanical stress, resulting in reduced image uniformity and removability in some cases.

Whether or not an inorganic oxide particle-containing layer is formed within 1 μm from the toner surface can be determined by observing the cross section of the toner particle using a transmission electron microscope (TEM).

Examples of inorganic oxide particles include oxides of metals (e.g., silicon, aluminum, titanium, zirconium, cerium, iron, and magnesium), silica, alumina, and titania. Among these, silica, alumina, and titania are preferable, and silica is most preferable.

An example of a method of providing an inorganic oxide particle-containing layer within 1 μm from the toner surface is as follows: For example, when a toner is produced by a process similar to dissolution suspension—one of wet processes, inorganic oxide particles are previously added to an organic solvent before dissolving or dispersing a toner material into the organic solvent.

Preferably, the inorganic oxide particles are added to the toner in an amount of 0.1% by mass to 2% by mass. If less than 0.1% by mass is used, the effect of inhibiting flocculation of toner particles may be impaired. If greater than 2% by mass is used, it may result in several problems—toner splashes between fine lines, contamination inside an image forming apparatus, and wear and tear on a photoconductor.

It is also preferable to modify the toner surface using a hydrophobizing agent. Examples of the hydrophobizing agent include dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, hexaphenyldisilazane, and hexatolyldisilazane.

The proportion of toner particles having a circle equivalent diameter (the diameter of a circle having the same area as the projection of toner particle) of 2 μm is preferably 20% or less on a number basis and, more preferably, 10% or less. By doing so it is possible to prevent temporal image quality reduction due to these fine toner particles.

In fine toner particles with a circle equivalent diameter of 2 μm or less, the charge density per unit mass (μC/g) is large because of their large surface area per unit mass, and therefore, they are less likely to be developed and transferred. In particular, after long time use, such fine toner particles remains in the development device to reduce the volume-average particle diameter of toner and firmly sticks to the surface of charging members such as a magnetic carrier. In this way they undesirably inhibit frictional electrification of large diameter toner particles (e.g., newly added toner particles), and toner particles that are insufficiently charged broaden the charge density distribution and form images affected with background fogging, thus reducing image quality with time.

The proportion (number %) of toner particles with a given circle equivalent diameter can be determined using a flow particle image analyzer (FPIA-2100, manufactured by Sysmex Corp.). More specifically, 1% NaCl aqueous solution is prepared using primary sodium chloride, and filtrated through a 0.45 μm pore size filter. To 50-100 ml of this solution is added 0.1-5 ml of a surfactant (preferably alkylbenzene sulfonate) as a dispersing agent, followed by addition of 1-10 mg of sample. The mixture is then sonicated for 1 minute using an ultrasonicator to prepare a dispersion with a final particle concentration of 5,000-15,000/μL for measurement. Measurement is made on the basis of a circle equivalent diameter—the diameter of a circle having the same area as the 2D image of a toner particle taken by a CCD camera. In view of resolution of the CCD camera, measurement data are collected from particles with a circle equivalent diameter of 0.6 μm or more.

The porosity of toner particles is preferably 60% or less under pressure of 10 kg/cm$^2$ and more preferably, 55% or less. The lower limit is preferably 45%. By doing so a regular toner layer with a minimum volume is developed on a photoconductor, producing an image with reduced image layer thickness and increased image uniformity. Thus it is possible to is provide high-quality images.

Figure 3:
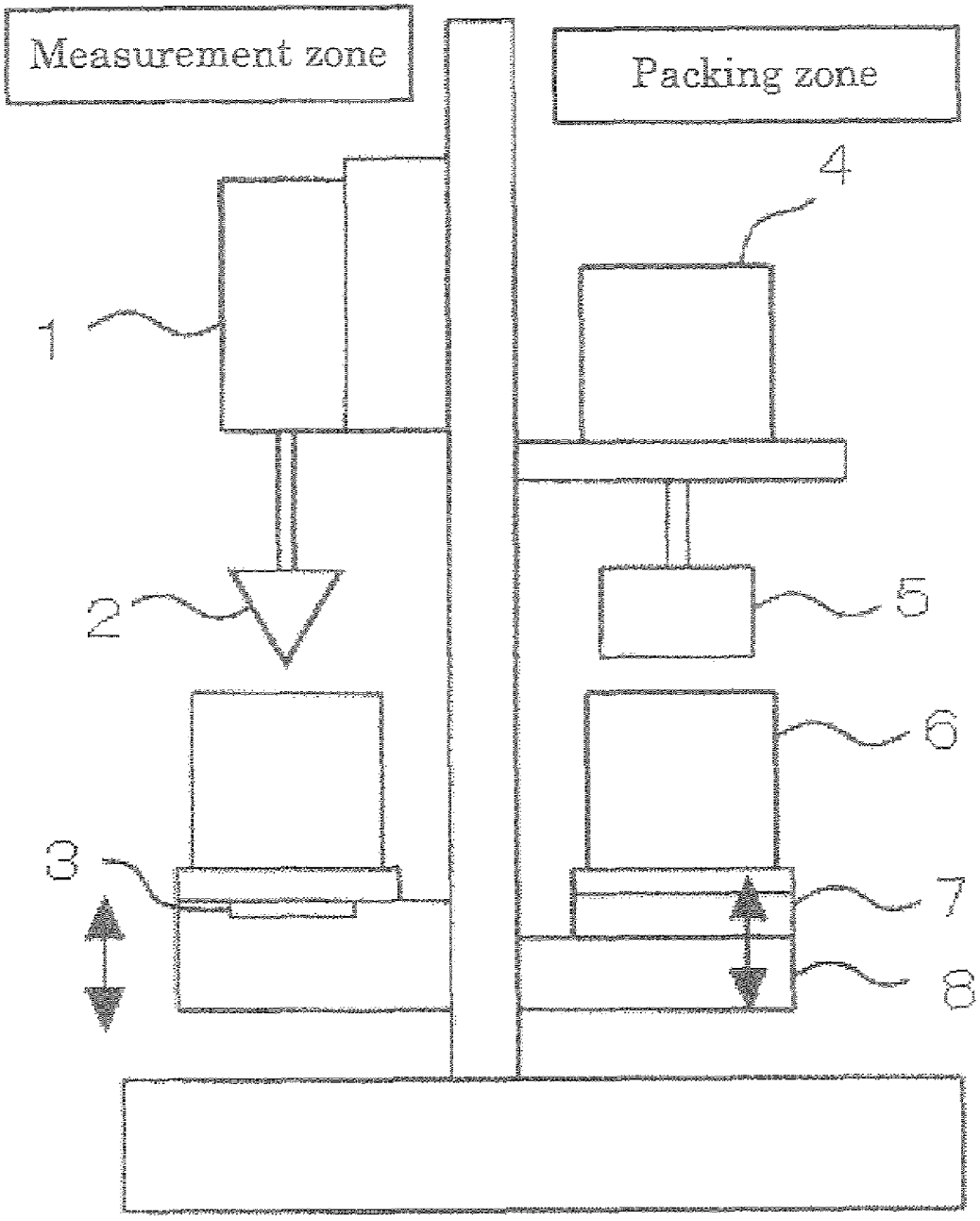
FIG. 3 is a schematic view showing an example of a device for measuring the porosity of toner particles.

The porosity of toner particles can be measured using, for example, a porosity measurement device shown in FIG. 3. The porosity measurement device includes a torque meter 1, a conical rotor 2, a load cell 3, a weight 4, a piston 5, a sample container 6, a shaker 7, and a lifting stage 8.

The porosity can be measured in the following manner. The sample container 6 is first charged with a given amount of toner, and attached to the measurement device. The torque meter 1 is operated to rotate the conical rotor 2, and the rotating conical rotor 2 is placed into toner powder. Prior to actual measurements, toner powder is placed under pressure of 10 kg/cm$^2$ for compression. The volume and weight of the compressed toner powder are measured to calculate its porosity while taking its specific gravity taken into consideration. In this measurement the smaller the porosity at a given pressure, the more likely that toner particles are packed, and packed particles show a regular structure like a closest packed structure. The same holds true for a developed toner.

The production process and constituent material of the toner of the present invention are not particularly limited as long as the foregoing requirements are met, and can be selected from those known in the art; for example, small diameter toners that are substantially spherical and have irregularities on their surfaces are preferable. Examples of the toner production process include the method of pulverization and classifying, and suspension polymerization, emulsion polymerization and polymer suspension for forming toner base particles by emulsifying, suspending or flocculating an oil phase in an aqueous medium.

The pulverization method is one for producing the toner base particles by melting and kneading toner material Note in this pulverization method that mechanical impacts may be applied to the resultant toner base particles to control their shapes so that the average circularity is in a range of 0.97 to 1.00. In this case, such mechanical impacts are applied to the toner base particles using, for example, a hybridizer or a mechanofusion machine.

In the suspension polymerization method, a colorant, a releasing agent, etc., are dispersed in a mixture of an oil-soluble polymerization initiator and polymerizable monomers, and the resultant monomer mixture is emulsified and dispersed by emulsification to be described later in an aqueous medium containing a surfactant, a solid dispersing agent, etc. After a polymerization reaction to produce toner particles, a wet process may be performed for attaching inorganic particles to their surfaces. At this point, inorganic particles are preferably attached after removal of excess surfactant or the like by washing.

Using some of the following polymerizable monomers it is possible to introduce functional groups to the resin particle surfaces. Examples of such polymerizable monomers include acids such as acrylic acid, methacrylic acid, α-cyanoacrylic acid, α-cyanomethacrylic acid, itaconic acid, crotonic acid, fumaric acid, maleic acid, and maleic acid anhydride; acrylamide, methacrylamide, diacetoneacrylamide and methylol derivatives thereof, acrylates and methacrylates bearing amino groups, such as vinylpyridine, vinylpyrrolidone, vinylimidazole, ethylenimine, and dimethylaminoethyl methacrylate.

Alternatively, functional groups can be introduced by using a dispersing agent having an acidic group and/or basic group that adsorbs to the resin particle surface.

In the emulsion polymerization method, a water-soluble polymerization initiator and polymerizable monomers are emulsified in water using a surfactant, followed by production of latex by general emulsion polymerization. Separately, a colorant, a releasing agent, etc. are dispersed in an aqueous medium to prepare a dispersion, which is then mixed with the latex. The latex particles are then coagulated to toner particle size, heated, and fused to one another to produce toner particles. Subsequently, a later described-wet process may be performed for the attachment of inorganic particles. Functional groups can be introduced to the resin particle surface by using monomers similar to those that may be used for the suspension polymerization of the latex.

In the present invention a toner produced by emulsifying or dispersing a toner material solution or a toner material dispersion in an aqueous medium is preferable, because the range of choice of available resins is wide, high low-temperature fixing property is ensured, toner particles can be readily produced, and it is easy to control the particle diameter, particle size distribution, and shape.

The toner material solution is prepared by dissolving the toner material in a solvent, and the toner material dispersion is prepared by dispersing the toner material in a solvent.

The toner material comprises an adhesive base material obtained by reacting together an active hydrogen group-containing compound, a polymer capable of reacting with the active hydrogen group-containing compound, a binder resin, a releasing agent, and a colorant. The toner material comprises additional ingredient(s) such as resin particles and/or a charge controlling agent on an as-needed basis —Adhesive Base Material—

The adhesive base material exhibits adhesion to a recording medium such as paper, comprises an adhesive polymer produced by reaction of the active hydrogen group-containing compound with the polymer capable of reacting with it in the aqueous medium, and may further comprise a binder resin suitably selected from those known in the art.

The weight-average molecular weight of the adhesive base material is not particularly limited and can be appropriately determined depending on the intended use. For example, the weight-average molecular weight is preferably 1,000 or more, more preferably 2,000 to 10,000,000 and most preferably, 3,000 to 1,000,000.

If the weight-average molecular weight is less than 1,000, anti-hot-offset property may be reduced.

The storage modulus of the adhesive base material is not particularly limited and can be appropriately determined depending on the intended purpose. For example, the temperature at which the storage modulus equals to 10,000 dyne/$cm^2$ at a measurement frequency of 20 Hz (i.e., TG') is generally 100° C. or more and more preferably 110° C. to 200° C. if TG' is less than 100° C., anti-hot-offset property may be reduced.

The viscosity of the adhesive base material is not particularly limited and can be appropriately determined depending on the intended purpose. For example, the temperature at which the viscosity equals to 1,000 poise at a measurement frequency of 20 Hz (i.e. Tη) is generally 180° C. or less and more preferably, 90° C. to 160° C. If Tη is greater than 180° C., low-temperature fixing property may be reduced.

In order to ensure excellent anti-hot-offset property and excellent low-temperature fixing property, TG' is preferably larger than Tη, i.e., the difference between TG' and Tη (or TG' minus Tη) is preferably 0° C. or greater, more preferably 10° C. or greater and most preferably, 20° C. or greater. Note that the greater the difference, the more preferable.

In addition, in order to ensure excellent anti-hot-offset property and excellent low-temperature fixing property, (TG' minus Tη) is preferably in a range of 0° C. to 100° C., more preferably 10° C. to 90° C. and most preferably, 20° C. to 80° C.

The adhesive base material is not particularly limited and can be suitably determined depending on the intended use; preferred examples include polyester resins.

The polyester resins are not particularly limited and can be suitably determined depending on the intended use; preferred examples include urea-modified polyester resins.

The urea modified polyesters are obtained by reacting, in the aqueous medium, (B) amines as the active hydrogen-containing compounds with (A) isocyanate group-containing polyester prepolymers as polymers capable of reacting with the active hydrogen-containing compounds.

In addition, the urea modified polyesters may include a urethane bond in addition to a urea bond. The molar ratio of the urea bond to the urethane bond (urea bond/urethane bond) is not particularly limited and can be appropriately determined; however, it is preferably in a range of 100/0 to 10/90, more preferably 80/20 to 20/80 and most preferably, 60/40 to 30/70. When the molar ratio of the urea bond is less than 10, it may result in reduced hot-offset property.

Preferred specific examples of the urea-modified polyesters are the following compounds (1)-(10):

(1) A mixture of (i) a urea-modified polyester prepolymer modified with isophorone diamine, the prepolymer obtained by reacting a polycondensation product of 2 mole ethylene oxide adduct of bisphenol A and isophthalic acid with isophorone diisocyanate, and (ii) a polycondensation product of 2 mole ethylene oxide adduct of bisphenol A and isophthalic acid;

(2) A mixture of (i) a urea-modified polyester prepolymer modified with isophorone diamine, the prepolymer obtained by reacting a polycondensation product of 2 mole ethylene oxide adduct of bisphenol A and isophthalic acid with isophorone diisocyanate, and (ii) a polycondensation product of 2 mole ethylene oxide adduct of bisphenol A and terephthalic acid;

(3) A mixture of (i) a urea-modified polyester prepolymer modified with isophorone diamine, the prepolymer obtained by reacting a polycondensation product of 2 mole ethylene oxide adduct of bisphenol A/2 mole propylene oxide adduct of bisphenol A and terephthalic acid with isophorone diisocyanate, and (ii) a polycondensation product of 2 mole ethylene oxide adduct of bisphenol A/2 mole propylene oxide adduct of bisphenol A and terephthalic acid;

(4) A mixture of (i) a urea-modified polyester prepolymer modified with isophorone diamine, the prepolymer obtained by reacting a polycondensation product of 2 mole ethylene oxide adduct of bisphenol A/2 mole propylene oxide adduct of bisphenol A and terephthalic acid with isophorone diisocyanate, and (ii) a polycondensation product of 2 mole ethylene oxide adduct of bisphenol A and terephthalic acid;

(5) A mixture of (i) a urea-modified polyester prepolymer modified with hexamethylenediamine, the prepolymer obtained by reacting a polycondensation product of 2 mole ethylene oxide adduct of bisphenol A and terephthalic acid with isophorone diisocyanate, and (ii) a polycondensation product of 2 mole ethylene oxide adduct of bisphenol A and terephthalic acid;

(6) A mixture of (i) a urea-modified polyester prepolymer modified with hexamethylenediamine, the prepolymer obtained by reacting a polycondensation product of 2 mole ethylene oxide adduct of bisphenol A and terephthalic acid with isophorone diisocyanate, and (ii) a polycondensation product of 2 mole ethylene oxide adduct of bisphenol A/2 mole propylene oxide adduct of bisphenol A and terephthalic acid;

(7) A mixture of (i) a urea-modified polyester prepolymer modified with ethylenediamine, the prepolymer obtained by reacting a polycondensation product of 2 mole ethylene oxide adduct of bisphenol A and terephthalic acid with isophorone diisocyanate, and (ii) a polycondensation product of 2 mole ethylene oxide adduct of bisphenol A and terephthalic acid;

(8) A mixture of (i) a urea-modified polyester prepolymer modified with hexamethylenediamine, the prepolymer obtained by reacting a polycondensation product of 2 mole ethylene oxide adduct of bisphenol A and terephthalic acid with diphenylmethane diisocyanate, and (ii) a polycondensation product of 2 mole ethylene oxide adduct of bisphenol A and isophthalic acid;

(9) A mixture of (i) a urea-modified polyester prepolymer modified with hexamethylenediamine, the prepolymer obtained by reacting a polycondensation product of 2 mole ethylene oxide adduct of bisphenol λ/2 mole propylene oxide adduct of bisphenol A and terephthalic acid/dodecenylsuccinic anhydride with diphenylmethane diisocyanate, and (ii) a polycondensation product of 2 mole ethylene oxide adduct of bisphenol A/2 mole propylene oxide adduct of bisphenol A and terephthalic acid; and

(10) A mixture of (i) a urea-modified polyester prepolymer modified with hexamethylenediamine, the prepolymer obtained by reacting a polycondensation product of 2 mole ethylene oxide adduct of bisphenol A and isophthalic acid with toluene diisocyanate, and (ii) a polycondensation product of b2 mole ethylene oxide adduct of bisphenol A and isophthalic acid.

—Active Hydrogen Group-Containing Compounds—

The active hydrogen group-containing compounds serve as an extension agent or crosslinking agent when a polymer capable of reacting with the active hydrogen group-containing compounds undergoes an extension reaction or crosslinking reaction in the aqueous medium.

The active hydrogen group-containing compound is not particularly limited and can be appropriately determined depending on the intended purpose as long as it has an active hydrogen group. For example, when the polymer capable of reacting with the active hydrogen group-containing compound is an isocyanate group-containing polyester prepolymer (A), amines (B) are preferably used because high-molecular weight polymers can be produced by reaction with the isocyanate group-containing polyester prepolymer (A) e.g., through extension reaction or crosslinking reaction.

The active hydrogen group is not particularly limited and can be appropriately determined depending on the intended use; examples include hydroxyl groups (alcoholic hydroxyl group or phenolic hydroxyl group) amino groups carboxyl groups and mercapto groups. These groups may be used singly or in combination. Among them an alcoholic hydroxyl group is particularly preferable.

The amines (B) are not particularly limited and can be appropriately determined depending on the intended use; examples include diamines (B1), polyamines containing three or more amine groups (B2), aminoalcohols (B3), aminomercaptans (B4), amino acids (B5), and compounds (B6) obtained by blocking the amino groups of (B1) to (B5)

These amines may be used singly or in combination. Among these, diamines (B1), and mixtures of diamines (B1) and a small amount of polyamines (B2) are most preferable.

Examples of the diamines (B1) include aromatic diamines, alicyclic diamines, and aliphatic diamines. Examples of the aromatic diamines include phenylenediamine, diethyltoluenediamine, and 4,4'-diaminodiphenylmethane Examples of the alicyclic diamines include 4,4'-diamino-3,3'-dimethyl dicyclohexylmethane, diaminocyclohexane, and isophoronediamine. Examples of the aliphatic diamines include ethylenediamine, tetramethylenediamine, and hexamethylenediamine.

Examples of the polyamines containing three or more amine groups (B2) include diethylenetriamine, and triethylenetetramine.

Examples of the aminoalcohols (B3) include ethanolamine, and hydroxyethylamine.

Examples of the amino mercaptans (B4) include aminoethylmercaptan, and aminopropylmercaptan.

Examples of the amino acids (B5) include aminopropionic acid, aminocaproic acid.

Examples of the compounds (B6) obtained by blocking the amino groups of (B1) to (B5) include ketimine compounds obtained from the foregoing amines (B1) to (B5) and ketones (e.g., acetone, methyl ethyl ketone, and methyl isobutyl ketone), and oxazolidone compounds.

To terminate an elongation reaction, cross-linking reaction, etc., between the active hydrogen group-containing compound and the polymer capable of reacting it, a reaction terminator can be used. The use of such a reaction terminator is preferable because the molecular weight of the adhesive base material can be controlled within a desired range. Examples of the reaction terminator include monoamines such as diethylamine, dibutylamine, butylamine and laurylamine, and compounds obtained by blocking these monoamines, such as ketimine compounds.

For the mixture ratio of the amine (B) to the isocyanate group-containing polyester prepolymer (A), the equivalent ratio of the isocyanate group [NCO] in the isocyanate group-containing prepolymer (A) to the amino group [NHx] in the amine (B) is preferably 1/3 to 3/1, more preferably 1/2 to 2/1 and most preferably, 1/1.5 to 1.5/1.

If the equivalent ratio ([NCO]/[NHx]) is less than 1/3, it may result in poor low-temperature fixing property. If the equivalent ratio is greater than 3/1, the molecular weight of the urea-modified polyester resin may decrease to result in poor anti-hot-offset property.

—Polymers Capable of Reacting with Active Hydrogen Group-Containing Compounds—

The polymers capable of reacting with the active hydrogen group-containing compounds (hereinafter referred to as "prepolymers" in some cases) are not particularly limited and can be appropriately selected from resins known in the art, as long as they at least has a site capable of reacting with the active hydrogen group-containing compounds. Examples such resins include polyol resins, polyacrylic resins, polyester resins, epoxy resins, and derivatives thereof.

These may be used singly or in combination. Among them, polyester resins are particularly preferable in light of their high-flowability and transparency upon melted.

In the prepolymers the site capable of reacting with the active hydrogen group-containing compounds is not particularly limited and can be appropriately selected from known substituents; examples include isocyanate group, epoxy group, carboxylic group, and acid chloride group.

These substituents may be included singly or in combination. Among them, an isocyanate group is particularly preferable.

Among the prepolymers, polyester resins containing groups that can produce a urea bond, or RMPE, are preferable because the molecular weight of the high-molecular weight component can be easily controlled, excellent oil-less low-temperature fixing property can be ensured for dry toners, and in particular, excellent releasing property and excellent fixing property can be ensured even when an oil-less fixing device is used.

Examples of the groups that can produce a urea bond include an isocyanate group.

When the group that can form a urea bond in the polyester resin RMPE is an isocyanate group, a suitable example of the polyester resin (RMPE) is the isocyanate group-containing polyester prepolymer (A).

The isocyanate group-containing polyester prepolymer (A) is not particularly limited and can be appropriately determined depending on the intended purpose; examples include polycondensation products resulted from polyols (PO) and polycarboxylic acids (PC), and those obtained by reacting the active hydrogen group-containing compounds with polyisocyanates (PIC).

The polyols (PO) are not particularly limited and can be appropriately determined depending on the intended purpose; examples include diols (DIO), polyols containing three or more hydroxyl groups (TO), and mixtures of diols (DIO) and a small amount of (TO). These polyols (PO) may be used singly or in combination. It is preferable, for example, to use the diols (DIC) alone, or to use mixtures of diols (DIO) and a small amount of (TO)

Examples of the diols (DIO) include alkylene glycols, alkylene ether glycols, alicyclic diols, alkylene oxide adducts of alicyclic diols, bisphenols, and alkylene oxide adducts of bisphenols.

The alkylene glycols preferably have 2 to 12 carbon atoms, and examples thereof include ethylene glycol, 1,2-propylene glycol, 1,3-propylene glycol, 1,4-butandiol, and 1,6-hexanediol. Examples of the alkylene ether glycols include diethylene glycol, triethylene glycol, dipropylene glycol, polyethylene glycol, polypropylene glycol, and polytetramethylene ether glycol. Examples of the alicyclic diols include 1,4-cyclohexane dimethanol, and hydrogenated bisphenol A. Examples of the alkylene oxide adducts of the alicyclic diols include those obtained by adding alkylene oxides such as ethylene oxide, propylene oxide, or butylene oxide to the alicyclic diols. Examples of the bisphenols include bisphenol A, bisphenol F, and bisphenol S. Examples of the alkylene oxide adducts of the bisphenols include those obtained by adding alkylene oxides such as ethylene oxide, propylene oxide, or butylene oxide to the bisphenols.

Among them, alkylene glycols of 2 to 12 carbon atoms, and alkylene oxide adducts of bisphenols are preferable. Alkylene oxide adducts of bisphenols, and mixtures of the alkylene oxide adducts of bisphenols and alkylene glycols of 2 to 12 carbon atoms are most preferable.

For the polyalcohols containing three or more hydroxyl groups (TO), those containing three to eight hydroxyl groups or those containing eight or more hydroxyl groups are preferable; examples include polyaliphatic alcohols containing three or more hydroxyl groups, polyphenols containing three or more hydroxyl groups, and alkylene oxide adducts of the polyphenols.

Examples of the polyaliphatic alcohols containing three or more hydroxyl groups include glycerine, trimethylol ethane, trimethylol propane, pentaerythritol, and sorbitol. Examples of the polyphenols containing three or more hydroxyl groups include trisphenol PA, phenol novolac, and cresol novolac. Examples of the alkylene oxide adducts of the polyphenols containing three or more hydroxyl groups include those obtained by adding alkylene oxides such as ethylene oxide, propylene oxide, or butylene oxide to the polyphenols containing three or more hydroxyl groups.

In the mixture of the diol (DIO) and the polyol containing three or more hydroxyl groups (TO), the mass ratio (DIO:TO) of diol (DIO) to polyol (TO) is preferably 100:0.01-10 and more preferably, 100:0.01-1.

The polycarboxylic acids (PC) are not particularly limited and can be appropriately determined depending on the intended purpose; examples include dicarboxylic acids (DIC), polycarboxylic acids containing three or more carboxyl groups (TC), and mixtures of the dicarboxylic acids (DIC) and the polycarboxylic acids (TC).

These polycarboxylic acids may be used singly or in combination. It is preferable to use dicarboxylic acids (DIC) alone, or to use mixtures of dicarboxylic acids (DIC) and a small amount of the polycarboxylic acids (TC).

Examples of the dicarboxylic acids include alkylene dicarboxylic acids, alkenylene dicarboxylic acids and aromatic dicarboxylic acids.

Examples of the alkylene dicarboxylic acids include succinic acid, adipic acid, and sebacic acid. For the alkenylene dicarboxylic acids, those having 4 to 20 carbon atoms are preferable, and examples thereof include maleic acid, and fumaric acid. For the aromatic dicarboxylic acids, those having 8 to 20 carbon atoms are preferable, and examples thereof include phthalic acid, isophthalic acid, terephthalic acid, and naphthalene dicarboxylic acid Among them, alkenylene dicarboxylic acids having 4 to 20 carbon atoms and aromatic dicarboxylic acids having 8 to 20 carbon atoms are preferable.

For the polycarboxylic acids containing three or more carboxyl groups (TO), those containing three to eight carboxyl groups and those containing eight or more carboxyl groups are preferable, and examples thereof include aromatic polycarboxylic acids.

For the aromatic polycarboxylic acids, those having 9 to 20 carbon atoms are preferable, and examples thereof include trimellitic acid and pyromellitic acid.

For the polycarboxylic acids (PC), acid anhydrides obtained from the dicarboxylic acids (DIC), the polycarboxylic acids containing three or more carboxyl groups (TC) and mixtures of the dicarboxylic acids (DTC) and the polycarboxylic acids (TC), or lower alkyl esters may be used Examples of the lower alkyl esters include methyl esters ethyl esters and isopropyl esters.

In the mixture of the dicarboxylic acid (DIC) and the polycarboxylic acid containing three or more carboxyl groups (TC), the mass ratio (DIC:TC) of dicarboxylic acid (DIC) to polycarboxylic acid (TC) is not particularly limited and can be appropriately determined depending on the intended purpose. For example, the mass ratio (DIC:TC) in the mixture is preferably 100:0.01-10 and more preferably, 100:0.01-1.

The mixture ratio of the polyols (PO) to the polycarboxylic acids (PC) in their polycondensation reaction is not particularly limited and can be appropriately determined depending on the intended purpose, for example, the equivalent ratio [OH]/[COOH] of hydroxyl group [OH] in the polyol (PO) to carboxyl group [COOH] in the polycarboxylic acid (PC) is preferably 2/1 to 1/1, more preferably 1.5/1 to 1/1 and most preferably, 1.3/1 to 1.02/1.

The content of the polyol (PO) in the isocyanate group-containing polyester prepolymer (A) is not particularly limited and can be appropriately determined depending on the intended purpose. For example, the content is preferably 0.5% by mass to 40% by mass, more preferably 1% by mass to 30% by mass and most preferably, 2% by mass to 20% by mass.

If the content of the polyol (PO) in the isocyanate group-containing polyester prepolymer (A) is less than 0.5% by mass, it may result in poor anti-hot-offset property and the resultant toner may not have excellent thermal stability and excellent low-temperature fixing property. If the content is greater than 40% by mass, it may result in poor low-temperature fixing property.

The polyisocyanates (PIC) are not particularly limited and can be appropriately determined depending on the intended purpose; examples include aliphatic polyisocyanates, alicyclic polyisocyanates, aromatic diisocyanates, aromatic aliphatic diisocyanates, isocyanurates, phenol derivatives thereof, and polyisocyanates blocked with oximes or caprolactams.

Examples of the aliphatic polyisocyanates include tetra ethylene diisocyanate, hexamethylene diisocyanate, and 2,6-diisocyanate methyl caproate, octamethylene diisocyanate, decamethylene diisocyanate, dodecamethylene diisocyanate, tetradecamethylene diisocyanate, trimethylhexane diisocyanates, and tetramethylhexane diisocyanates. Examples of the alicyclic polyisocyanates include isophorone diisocyanate, and cyclohexylmethane diisocyanate. Examples of the aromatic diisocyanates include tolylene diisocyanate, and diphenylmethane diisocyanate, 1,5-naphthilene diisocyanate, diphenylene-4,4'-diisocyanato, 4, 4-diisocyanate-3, 3'-dimethylphenyl, 3-methyldiphenyl methane-4, 4'-diisocyanate, and diphenyl ether-4, 4-diisocyanate. Examples of the aromatic aliphatic diisocyanates include α, α, α', α'-tetramethylxylylene diisocyanate. Examples of the isocyanurates include tris-isocyanatoalkyl-isocyanurate, and triisocyanatocycloalkyl-isocyanurates.

These polyisocyanates may be used singly or in combination.

In the reaction between the polyisocyanate and the active hydrogen group-containing polyester resin (e.g., hydroxyl group-containing polyester resin), the equivalent ratio [NCO]/[OH] of isocyanate group [NCO] in the polyisocyanate (PIC) to hydroxyl group [OH] in the hydroxyl group-containing polyester resin is preferably 5/1 to 1/1, more preferably 4/1 to 1.2/1 and most preferably, 3/1 to 1.5/1.

If the ratio of isocyanate group [NCO] exceeds 5, it may result in poor low-temperature fixing property. If the ratio of isocyanate group [NCO] is less than 1, it may result in poor anti-offset property.

The content of polyisocyanate (PIC) component in the isocyanate group-containing polyester prepolymer (A) is not particularly limited and can be appropriately determined depending on the intended purpose, for example, it is preferably 0.5% by mass to 40% by mass, more preferably 1% by mass to 30% by mass and most preferably, 2% by mass to 20% by mass.

If the content is less than 0.5% by mass, it may result in poor anti-hot-offset property and it may be difficult for the resultant toner to have excellent thermal stability and excellent low-temperature fixing property. If the content is greater than 40% by mass, it may result in poor low-temperature fixing property.

The average number of isocyanate groups contained in per molecule of the isocyanate-group containing polyester prepolymer (A) is preferably one or more, more preferably 1.2 to 5 and most preferably, 1.5 to 4.

If the average number of isocyanate groups per molecule is less than 1, the molecular weight of the polyester resin modified by the group for producing a urea bond (RMPE) may decrease to result in poor anti-hot-offset property.

The weight-average molecular weight (Mw) of the polymer capable of reacting with the active hydrogen group-containing compound is preferably 1,000 to 30,000 and more preferably, 1,500 to 15,000, as determined by gel permeation chromatography (GPC) on the basis of the molecular weight distribution of polymer dissolved in tetrahydrofuran (THF). If the weight-average molecular weight (Mw) of the polymer is less than 1,000, it may result in poor thermal stability of toner, and if the weight-average molecular weight (Mw) of the polymer is greater than 30,000, it may result in poor low-temperature fixing property.

Determination of the molecular weight distribution by GPC can be carried out in the following procedure, for example.

A column is first equilibrated in a heat chamber of 40° C. At this temperature tetrahydrofuran (THF), a column solvent, is passed through the column at a flow rate of 1 ml/min, and a sample solution containing a concentration of 0.05-0.6% by mass of resin in tetrahydrofuran is prepared, and 50-200 μl of the sample solution is passed through the column. Upon determination of the sample molecular weight, a molecular weight calibration curve constructed from several monodisperse polystyrene standards is used to obtain a molecular weight distribution of the sample solution on the basis of the relationship between logarithm values of the curve and count values. For the polystyrene standards for the calibration curve those with a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ (produced by Pressure Chemical Corp, or Toyo Soda Manufacturing Co., Ltd.) are preferably used It is also preferable to use at least 10 different polystyrene standards. For a detector, a refractive index (RI) detector is used.

—Binder Resin—

The binder resin is not particularly limited and can be appropriately determined depending on the intended purpose; examples include polyesters. Of these, unmodified polyester resins (i.e., polyester resins that are not modified) are particularly preferable.

The addition of such an unmodified polyester resin in toner leads to improved low-temperature fixing properties and makes image glossy.

Examples of the unmodified polyester resins include resins identical to the foregoing polyester resins containing a group that produces a urea bond (RMPE), i.e., polycondensation products of polyols (PO) and polycarboxylic acids (PC). In view of low-temperature fixing properties and hot-offset property, a part of the unmodified polyester resin is preferably compatible with the polyester resin containing a group that produces a urea bond (RMPE), i.e., the unmodified polyester resins and the polyester resins (RMPE) preferably share a similar structure that allow them to be compatible.

The weight-average molecular weight (Mw) of the unmodified polyester resin is preferably 1,000 to 30,000 and more preferably, 1,500 to 15,000 as determined by gel permeation chromatography (GPC) on the basis of the molecular weight distribution of polymer dissolved in tetrahydrofuran (THF).

If the weight-average molecular weight (Mw) of the unmodified polyester resin is less than 1,000, it may result in poor thermal stability of toner. Therefore, it is required that the content of an unmodified polyester resin with a weight-average molecular weight of less than 1,000 be 8% by mass to 28% by mass. If the weight-average molecular weight (Mw) of the unmodified polyester resin is greater than 30,000, it may result in poor low-temperature fixing property.

The glass transition temperature of the unmodified polyester resins is generally 30° C. to 70° C., preferably 35° C. to 70° C., more preferably 35° C. to 70° C. and most preferably, 35° C. to 45° C. If the glass transition temperature is below 30° C., it may result in poor thermal stability of toner. If the glass transition temperature is above 70° C., it may result in insufficient lower temperature fixing property.

The hydroxyl value of the unmodified polyesters is preferably 5 mg KOH/g or more, more preferably 10 mg KOH/g to 120 mg KOH/g and most preferably, 20 mg KOH/g to 80 mg KOH/g. If the hydroxyl value is less than 5 mg KOH/g, it may difficult for the resultant toner to achieve excellent thermal stability and excellent low-temperature fixing property.

The acid value of the unmodified polyester resins is preferably 1.0 mg KOH/g to 50.0 mg KOH/g, more preferably 1.0 mg KOH/g to 45.0 mg KOH/g and most preferably, 15.0 mg KOH/g to 45.0 mg KOH/g. In general, toner having an acid value can be readily charged negatively.

When the unmodified polyester resin is contained in the toner material in the mixture, the mass ratio of the polymer capable of reacting with the active hydrogen group-containing compounds (e.g., a polyester resin containing a group that produces a urea bond) to the unmodified-polyester resin is preferably 5/95 to 80/20 and more preferably, 10/90 to 25/75.

If the mass ratio of the unmodified polyester resin (PE) exceeds 95 in the mixture, anti-hot-offset property may be reduced and it may difficult for the resultant toner to achieve excellent thermal stability and excellent low-temperature fixing property. If the mass ratio of the unmodified polyester is less than 20, image glossiness may be reduced.

The content of the unmodified polyester resin in the binder resin is preferably 50% by mass to 100% by mass, more preferably 75% by mass to 95% by mass, and most preferably 80% by mass to 90% by mass, for example. If the content is less than 50% by mass, it may result in poor low-temperature fixing property and/or image glossiness may be reduced.

—Colorant—

The colorant is not particularly limited and can be appropriately selected from known dyes and pigments accordingly. Examples include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet MD, Vulcan Fast Rubine B, Brilliant Scarlet G, Lithol Rubine GX, Permanent Red F5R, Brilliant Carmine 6B, Pigment Scarlet 3B, Bordeaux SB, Toluidine Maroon, Permanent Bordeau F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone.

These may be used singly or in combination.

The content of the colorant in the toner is not particularly limited and can be appropriately determined depending on the intended purpose; however, it is preferably 1% by mass to 15% by mass and more preferably, 3% by mass to 10% by mass.

If the content of the colorant is less than 1% by mass, the tinting power of the toner may degrade. If the content of the colorant is greater than 15% by mass, abnormal pigment dispersion occurs in toner, and it may reduce the tinting power and electric characteristics of toner.

The colorants may be used as a master batch combined with resin. The resin is not particularly limited and can be appropriately selected from those known in the art; examples include polymers of styrene or substituted styrene, styrene copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rosins, modified rosins, terpene resins, aliphatic hydrocarbon resins, alicyclic hydrocarbon resins, aromatic petroleum resins, chlorinated paraffins, and paraffins. These resins may be used singly or in combination.

Examples of the polymers of styrene or substituted styrene include polyester resins, polystyrenes, poly-p-chlorostyrenes, and polyvinyl toluenes. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymer, styrene-acrylonitrile copolymers, styrene-vinylmethyl-keton copolymers, styrene-butadiene copolymers, styrene-isoprene copolymers, styrene-acrylonitrile-indene copolymers, styrene-maleic acid copolymers, and styrene-ester maleate copolymers.

The master batch may be produced by mixing or kneading the master batch resin with the colorant while applying a high shearing force. Here, for increased interaction between the colorant and resin, an organic solvent may be added thereto. Alternatively, a so-called flashing process is preferably used, because in the flashing process a colorant wet cake can be used as it is without drying. The flashing process is a process in which an aqueous paste of colorant is mixed and kneaded with resin together with an organic solvent to thereby transfer the colorant to the resin side for removable of moisture and the organic solvent. For the mixing and kneading, a high shearing dispersion device (e.g., a triple roll mill) is preferably used.

—Additional Ingredients—

The additional ingredients are not particularly limited and can be appropriately determined depending on the intended purpose; examples include a releasing agent, charge controlling agent, inorganic particles, cleaning improver, magnetic material, and metallic soap.

The releasing agent is not particularly limited and can be appropriately selected from those known in the art; suitable examples include waxes.

Examples of such waxes include long-chain hydrocarbons, carbonyl group-containing waxes, and polyolefin waxes. These waxes may be used singly or in combination. Among them, carbonyl group-containing waxes are preferable.

Examples of the carbonyl group-containing waxes include polyalkanoic acid esters, polyalkanol esters, polyalkanoic acid amides, polyalkyl amides, and dialkyl ketones Examples of the polyalkanoic acid esters include carnauba wax, montan wax, trimethylolpropane tribehenate, pentaerythritol tetrabehenate, pentaerythritol diacetate dibehenate, glycerin tribehenate, and 1,18-octadecanediol distearate. Examples of the polyalkanol esters include trimellitic tristearate, and distearyl maleate. Examples of the polyalkanoic acid amide include behenyl amides. Examples of the polyalkyl amide include trimellitic acid tristearyl amide. Examples of the dialkyl ketones include distearyl ketone. Of these carbonyl group-containing waxes, polyalkanoic esters are most preferable.

Examples of the polyolefin waxes include polyethylene waxes, and polypropylene waxes.

Examples of the long-chain hydrocarbons include paraffin waxes, and Sasol Wax.

The melting point of the releasing agent is not particularly limited and can be appropriately determined depending on the intended purpose; it is preferably 40° C. to 160° C., more preferably 50° C. to 120° C. and most preferably 60° C. to 90° C.

If the melting point of the releasing agent is below 40° C., the wax may impair thermal stability of toner. If the melting point of the releasing agent is below 160° C., cold-off set may occur upon low-temperature fixing.

The melt viscosity of the releasing agent is preferably 5 cps to 1,000 cps and more preferably, 10 cps to 100 cps when measured at a temperature higher than the melting point of the releasing agent by 20° C.

If the melt viscosity of the releasing agent is less than 5 cps, it may result in poor releasing property. If the melt viscosity of the releasing agent is greater than 1,000 cps, it may result in poor anti-hot-offset property and low-temperature fixing property.

The content of the releasing agent in the toner is not particularly limited and can be appropriately determined depending on the intended purpose; it is preferably 0% by mass to 40% by mass and more preferably, 3% by mass to 30% by mass.

If the content of the releasing agent is greater than 40% by mass, toner flowability may be reduced.

The charge controlling agent is not particularly limited and can be appropriately selected from those known in the art. However, when a colored material is used for the charge controlling agent, toner may show different tones of color; therefore, colorless materials or materials close to white are preferably used. Examples include, triphenylmethane dyes, molybdic acid chelate pigments, rhodamine dyes, alkoxy amines, quaternary ammonium salts (including fluoride-modified quaternary ammonium salts), alkylamides, phosphorus or compounds thereof, tungsten or compounds thereof, fluoride activators, metal salts of salicylic acid, and metal salts of salicylic acid derivatives. These may be used singly or in combination.

For the charge controlling agent, commercially available products may be used; examples include Bontron P-51, a quaternary ammonium salt, Bontron E-82, an oxynaphthoic acid metal complex, Bontron E-84, a salicyclic acid metal complex, and Bontron-89, a phenol condensate (produced by Orient Chemical Industries, Ltd.) TP-302 and TP-415, both are a quaternary ammonium salt molybdenum metal complex (produced by Hodogaya Chemical Co.); Copy Charge PSY VP2038, a quaternary ammonium salt, Copy Blue PR, a triphenylmethane derivative, and Copy Charge NEG VP2036 and Copy Charge NX VP434, both are a quaternary ammonium salt (produced by Hoechst Ltd.); LRA-901, and LR-147, a boron metal complex (produced by Japar Carlit Co, Ltd.); quinacridones; azo pigments; and high-molecular weight compounds bearing a functional group (e.g., sulfonic group and carboxyl group).

The charge controlling agent may be melted and kneaded with the master batch prior to dissolution or dispersion. Alternatively, the charge controlling agent may be dissolved or dispersed in the organic solvent together with the foregoing toner ingredients or may be attached to resultant toner particles.

The proper content of the charge controlling agent in the toner varies depending on the type of the binder resin, presence of an additive, the method of dispersion, etc. However, it is preferably present in the toner in an amount of 0.1 part by mass to 10 parts by mass per 100 parts by mass of the binder resin and, more preferably, 0.2 part by mass to 5 parts by mass. If less than 0.1 part by mass is used, it may be difficult to control the amount of charge. If greater than 10 parts by mass is used, toner is so excessively charged that the effects of the controlling agent are reduced, causing the toner to be firmly attracted to a developing roller by electrostatic attraction force. For these reasons, developer flowability may be reduced and/or image density may be reduced.

—Resin Particles—

The resin particles are not particularly limited and can be appropriately selected from resins known in the art as long as the resin particles are capable of forming an aqueous dispersion in an aqueous medium; it may be either thermoplastic resin or thermosetting resin, and examples include vinyl resins, polyurethane resins, epoxy resins, polyester resins, polyamide resin, polyimide resins, silicone resins, phenol resins, melamine resins, urea resins, aniline resins, ionomer resins, and polycarbonate resins Among these, vinyl resins are preferable.

These may be used singly or in combination. The resin particles are preferably formed of one resin selected from the vinyl resins, polyurethane resins, epoxy resins, and polyester resins in view of easy production of an aqueous dispersion containing fine and spherical resin particles.

The vinyl resins are homopolymers or copolymers of vinyl monomers. Examples include styrene-(meth)acrylic ester resins, styrene-butadiene1 copolymers, (meth)acrylic acid-acrylic ester copolymers, styrene-acrylonitrile copolymers, styrene-maleic anhydride copolymers, and styrene-(meth) acrylic acid copolymers In addition, copolymers containing monomers that have at least two unsaturated groups can also be used for the formation of the resin particles.

The monomer that contains at least two unsaturated groups is not particularly limited and can be appropriately determined depending on the intended purpose; examples include a sodium salt of sulfuric acid ester of ethylene oxide adduct of methacrylic acid (Eleminol RS-30, produced by Sanyo Chemical Industries Co.), divinylbenzene, and 1,6-hexanediol acrylate.

The resin particles are formed by polymerization of the foregoing monomers in accordance with a conventional method appropriately selected. The resin particles are preferably produced in an aqueous dispersion. Examples of the method for preparing such an aqueous dispersion are the following (1) to (8): (1) in a case of the foregoing vinyl resin, vinyl monomers as a starting material are polymerized by suspension polymerization, emulsification polymerization, seed polymerization, or dispersion polymerization to directly prepare an aqueous dispersion of resin particles; (2) in a case of resin obtained by polyaddition or polycondensation reaction (e.g., the foregoing polyester resin, polyurethane resin, or epoxy resin), a precursor (monomers, oligomers or the like) or a solution containing the precursor is dispersed in an aqueous medium in the presence of an appropriate dispersing agent, and is heated or added with a curing agent for curing to prepare an aqueous dispersion of resin particles; (3) in a case of resin obtained by polyaddition or polycondensation reaction (e.g., the foregoing polyester resin, polyurethane resin, or epoxy resin), an appropriately selected emulsifier is dissolved in a precursor (monomer, oligomer or the like) or in a solution containing the precursor (Preferably a liquid solution; it may be liquefied by heat), followed by addition of water to induce phase inversion emulsification to prepare an aqueous dispersion of resin particles; (4) resin that has previously been prepared by polymerization (addition polymerization, ring-opening polymerization, polyaddition, addition condensation, or condensation polymerization) is pulverized in a blade-type or jet-type pulverizer, the resultant resin powder is classified to produce resin particles, and the resin particles are dispersed in an aqueous medium in the presence of an appropriately selected dispersing agent to prepare an aqueous dispersion of the resin particles; (5) resin that has previously been prepared by polymerization (addition polymerization, ring-opening polymerization, polyaddition, addition condensation, or condensation polymerization) is dissolved in a solvent to prepare a resin solution, the resin solution is sprayed in the form of mist to produce resin particles, and the resultant resin particles are dispersed in an aqueous medium in the presence of an appropriately selected dispersing agent to prepare an aqueous dispersion of the resin particles; (6) resin that has previously been prepared by polymerization (addition polymerization, ring-opening polymerization, polyaddition, addition condensation, or condensation polymerization) is dissolved in a solvent to prepare a resin solution, resin particles are precipitated by the addition of a poor solvent or by cooling the resin solution, the solvent is removed to recover the resin particles, and the resin particles thus obtained are dispersed in an aqueous medium in the presence of an appropriately selected dispersing agent to prepare an aqueous dispersion of the resin particles; (7) resin that has previously been prepared by polymerization (addition polymerization, ring-opening polymerization, polyaddition, addition condensation, or condensation polymerization) is dissolved in a solvent to prepare a resin solution, the resin solution is dispersed in an aqueous medium in the presence of an appropriately selected dispersing agent, and the solvent is removed by heating or vacuum to prepare an aqueous dispersion of the resin particles; and (8) resin that has previously been prepared by polymerization (addition polymerization, ring-opening polymerization, polyaddition, addition condensation, or condensation polymerization) is dissolved in a solvent to prepare a resin solution, an appropriately selected emulsifier is dissolved in the resin solution, and water is added to the resin solution to induce phase inversion emulsification to thereby prepare an aqueous dispersion of resin particles.

Examples of the toner include those produced by known suspension polymerization, emulsion aggregation, or emulsion dispersion. Toners prepared in the following procedure are also preferable: A toner material containing an active hydrogen group-containing compound and a polymer capable of reacting with the compound is dissolved in an organic solvent to prepare a toner solution the toner solution is dispersed in an aqueous medium to prepare a dispersion, where the active hydrogen group-containing compound is allowed to react with the polymer to produce a particulate adhesive base material, and the organic solvent is removed to prepare toner particles.

—Toner Solution—

The preparation of the toner solution is carried out by dissolving the toner material in the organic solvent.

—Organic Solvent—

The organic solvent is not particularly limited and can be appropriately determined depending on the intended purpose, as long as it is a solvent capable of dissolving and dispersing the toner material. The organic solvent is preferably selected from volatile organic solvents with a boiling point of less than 150° C. because they can be readily removed; examples include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these organic solvents, toluene, xylene, benzene, methylene chloride, 1,2-dichloroethane, chloroform, carbon tetrachloride and the like are preferable, and ethyl acetate is most preferable. These organic solvents may be used singly or in combination.

The added amount of the organic solvent is not particularly limited and can be appropriately determined depending on the intended purpose. It is preferably added in an amount of 40 parts by mass to 300 parts by mass per 100 parts by mass of the toner material, more preferably 60 parts by mass to 140 parts by mass and, most preferably, 80 parts by mass to 120 parts by mass.

—Dispersion—

The preparation of the dispersion is carried out by dispersing the toner solution in an aqueous medium.

When the toner solution is dispersed in the aqueous medium, solid dispersions (oil droplets) derived from the toner solution are formed in the aqueous medium.

—Aqueous Medium—

The aqueous medium is not particularly limited and can be appropriately selected from those known in the art; examples include water, water-miscible solvents, and mixtures thereof. Among them, water is most preferable.

The water-miscible solvents are not particularly limited as long as they are miscible in water, and examples include alcohols, dimethylformamide, tetrahydrofurans, cellosolves, and lower ketones.

Examples of the alcohols include methanol, isopropanol, and ethylene glycol Examples of the lower ketones include acetone, and methyl ethyl ketone.

These organic solvents may be used singly or in combination.

The toner solution is preferably dispersed in the aqueous medium with agitation.

The method of dispersing is not particularly limited and a known dispersing device can be used. Examples of such a dispersing device include a low-speed shearing dispersing device, a high-speed shearing dispersing device, a friction-type dispersing device, a high-pressure jet dispersing device, and an ultrasonic dispersing device. Among these, a high-speed shearing dispersing device is preferable because it is possible to set the diameter of the solid dispersion (oil droplets) to 2 μm to 20 μm.

When a high-speed shearing dispersing device is used, the rotational speed, dispersing time, dispersing temperature, etc., are not particularly limited and can be appropriately set according to the intended purpose. For example, the rotational speed is preferably 1,000 rpm to 30,000 rpm and, more preferably, 5,000 rpm to 20,000 rpm. In a case of a batch-type dispersing device, the dispersing time is preferably 0.1 to 5 minutes, and the dispersing temperature is preferably 0° C. to 150° C. and, more preferably, 40° C. to 98° C. Note that in general, the higher the dispersing temperature, the easier it is to disperse.

As an example of the toner production process, a toner production process will be described in which a particulate adhesive base material is produced to obtain toner.

In this process an aqueous medium phase, the toner solution and the dispersion are prepared, the aqueous medium is added, and other steps (e.g., synthesis of a prepolymer capable of reacting with the active hydrogen group-containing compounds, and synthesis of these active hydrogen group-containing compounds) are performed.

The preparation of the aqueous medium phase can be carried out by dispersing the resin particles in the aqueous medium. The content of the resin particles in the aqueous medium is not particularly limited and can be appropriately determined depending on the intended purpose; for example it is preferably present in an amount of 0.5% by mass to 10% by mass.

The preparation of the toner solution can be carried out by dissolving or dispersing toner materials—the active hydrogen group-containing compound, polymer capable of reacting with the compound, colorant, charge controlling agent, unmodified polyester resin, etc.—in the organic solvent. In addition, inorganic oxide particles such as silica or titania can be added to the organic solvent in order to form an inorganic oxide particle-containing layer within 1 μm from the toner surface.

Among the toner materials, ingredients other than the prepolymer (or polymer capable of reacting with the active hydrogen group-containing compound) may be added to the organic solvent at the time when the resin particles are dispersed therein, or may be added to the aqueous medium phase at the time when the toner solution is added thereto.

The preparation of the dispersion can be carried out by emulsifying or dispersing the toner solution in the aqueous medium phase. Causing both the active hydrogen group-containing compound and the polymer capable of reacting with this compound to undergo extension or crosslinking reaction leads to formation of the adhesive base material.

For example, the adhesive base material (e.g. the urea-modified polyester) may be produced in any one of the following manner (1) to (3): (1) the toner solution containing the polymer capable of reacting with the active hydrogen group-containing compound (e.g., the isocyanate group-containing polyester prepolymer (A)) is emulsified or dispersed in the aqueous medium phase together with the active hydrogen group-containing compound to form solid dispersions, allowing the active hydrogen group-containing compound and the polymer capable of reacting with the active hydrogen group-containing compound to undergo extension or crosslinking reaction in the aqueous medium phase; (2) the toner solution is emulsified or dispersed in the aqueous medium in which the active hydrogen group-containing compound has been previously added, forming the solid dispersions, and then the active hydrogen group-containing compound and the polymer capable of reacting with this compound are allowed to undergo extension or crosslinking reaction in the aqueous medium phase; and (3) after adding the toner solution to the aqueous medium phase followed by mixing, the active hydrogen group-containing compound is added thereto to form solid dispersions, and then the active hydrogen group-containing compound and the polymer capable of reacting with this compound are allowed to undergo extension or crosslinking reaction at particle interfaces in the aqueous medium phase. In the case of procedure (3), it should be noted that modified polyester resin is preferentially formed on the surfaces of toner particles, allowing generation of a concentration gradient in the toner particles.

Reaction conditions under which the adhesive base material is produced by emulsification or dispersion are not particularly limited and can be appropriately set according to the combination of the active hydrogen group-containing compound with the polymer capable of reacting with it. The reaction time is preferably 10 minutes to 40 hours and, more preferably, 2 hours to 24 hours. The reaction temperature is preferably 0° C. to 150° C. and, more preferably, 40° C. to 98° C.

A suitable example of the method for stably forming in the aqueous medium phase the solid dispersions that contain the active hydrogen group-containing compound and a polymer capable of reacting with this compound (e.g., the isocyanate group-containing polyester prepolymer (A)) is as follows: the toner solution in which toner materials such as a polymer capable of reacting with the active hydrogen group-containing compound (e.g., the isocyanate group-containing polyester prepolymer (A)) colorant, charge controlling agent, unmodified polyester resin, etc., are dissolved or dispersed in the organic solvent is added to the aqueous medium phase, and is dispersed by application of shearing force. Note that description for the method of dispersing is similar to that given above.

Upon preparation of the dispersion, a dispersing agent is preferably used where necessary in order to stabilize the solid dispersions (oil droplets derived from the toner solution), to obtain a desired particle shape, and to sharpen the particle size distribution.

The dispersing agent is not particularly limited and can be appropriately determined depending on the intended purpose. Suitable examples include surfactants, water-insoluble inorganic dispersing agents, and polymeric protective colloids. These dispersing agents may be used singly or in combination.

Examples of the surfactants include anionic surfactants, cationic surfactants, nonionic surfactants, and ampholytic surfactants.

Examples of the anionic surfactants include alkylbenzene sulfonic acid salts, α-olefin sulfonic acid salts, and phosphoric acid esters. Among these, those having a fluoroalkyl group are preferable.

Examples of the anionic surfactants having a fluoroalkyl group include fluoroalkyl carboxylic acids of 2-10 carbon atoms or metal salts thereof, disodium perfluorooctanesulfonylglutamate, sodium-3-{omega-(C6-C11)fluoroalkyloxy}-1-(C3-C4)alkyl sulfonates, sodium-3-{omega-(C6-C8-fluoroalkanoyl-N-ethylamino}-propanesulfonates (C11-C20) fluoroalkyl carboxylic acids or metal salts thereof, (C7-C11) perfluoroalkyl carboxylic acids or metal salts thereof, (C4-C12) perfluoroalkyl sulfonic acids or metal salts thereof, perfluorooctanesulfonic acid diethanol amide, N-propyl-N-(2-hydroxyethyl)perfluorooctanesulfone amide, (C6-C10) perfluoroalkylsulfoneamidepropyltrimethylammonium salts, salts of (C6-C10)perfluoroalkyl-N-ethylsulfonyl glycin, and (C6-C16)monoperfluoroalkylethyl phosphates Examples of the commercially available surfactants having a fluoroalkyl group include Surflon S-111, S-112 and S-113 (manufactured by Asahi Glass Co.); Frorard FC-93, FC-95, FC-98 and FC-129 (manufactured by Sumitomo 3M Ltd.); Unidyne DS-101 and DS-102 (manufactured by Daikin Industries, Ltd.); Megafac F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co.); and Futargent F-100 and F150 (manufactured by Neos Co.).

Examples of the cationic surfactants include amine salts, and quaternary amine salts. Examples of the amine salts include alkyl amine salts, aminoalcohol fatty acid derivatives, polyamine fatty acid derivatives, and imidazolines. Examples of the quaternary ammonium salts include alkyltrimethyl ammonium salts, dialkyldimethyl ammonium salts, alkyldimethyl benzyl ammonium salts, pyridinium salts, alkyl isoquinolinium salts, and benzethonium chlorides. Among these, preferable examples are primary, secondary or tertiary aliphatic amine acids having a fluoroalkyl group, aliphatic quaternary ammonium salts such as (C6-C10)perfluoroalkyl sulfoneamidepropyltrimethylammoium salts, benzalkonium salts, benzetonium chlorides, pyridinium salts, and imidazolinium salts. Specific examples of commercially available products thereof include Surflon S-121 (manufactured by Asahi Glass Co.), Frorard FC-135 (manufactured by Sumitomo 3M Ltd.), Unidyne DS-202 (manufactured by Daikin Industries, Ltd.), Megaface F-150 and F-824 (manufactured by Dainippon Ink and Chemicals, Inc.), Ectop EF-132 (manufactured by Tohchem Products Co), and Futargent F-300 (manufactured by Neos Co.).

Examples of the nonionic surfactants include fatty acid amide derivatives, and polyalcohol derivatives.

Examples of the ampholytic surfactants include alanine, dodecyldi(aminoethyl)glycin, di(octylaminoethyle)glycin, and N-alkyl-N,N-dimethylammonium betaine.

Examples of the water-insoluble inorganic dispersing agents include tricalcium phosphate, calcium carbonate, titanium oxide, colloidal silica, and hydroxyl apatite.

Examples of the polymeric protective colloids include acids, hydroxyl group-containing (meth)acryl monomers, vinyl alcohol or ethers thereof, esters of vinyl alcohol and carboxyl group-containing compounds, amide compounds or methylol compounds thereof, chlorides, homopolymers or copolymers of monomers containing a nitrogen atom or heterocyclic ring containing a nitrogen atom, polyoxyethylenes, and celluloses.

Examples of the acids include acrylic acid, methacrylic acid, α-cycnoacrylic acid, α-cycnomethacrylic acid, itaconic acid, crotonic acid, fumaric acid, maleic acid, and maleic anhydride. Examples of the hydroxyl group-containing (meth)acryl monomers include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylates, diethyleneglycol monomethacrylate, glycerin monoacrylate, glycerin monomethacrylate, N-methylol acrylamide, and N-methylol methacrylamide. Examples of ethers of vinyl alcohol include vinyl methyl ether, vinyl ethyl ether, and vinyl propyl ether. Examples of esters of vinyl alcohol and carboxyl group-containing compounds include vinyl acetate, vinyl propionate, and vinyl butyrate. Examples of the amide compounds or methylol compounds thereof include acrylamide, methacrylamide, diacetone acrylicamide acid, and methylol compounds thereof. Examples of the chlorides include acrylic chloride, and methacrylic chloride. Examples of the homopolymers or copolymers having a nitrogen atom or heterocyclic ring containing a nitrogen atom include vinyl pyridine, vinyl pyrrolidone, vinyl imidazole, and ethylene imine Examples of the polyoxyethylenes include polyoxyethylene, polyoxypropylene, polyoxyethylene alkylamines, polyoxypropylene alkylamines, polyoxyethylene alkylamides, polyoxypropylene alkylamides, polyoxyethylene nonylphenylethers, polyoxyethylene laurylphenylethers, polyoxyethylene stearylarylphenyl esters, and polyoxyethylene nonylphenyl esters. Examples of the celluloses include methyl cellulose, hydroxyethyl cellulose, and hydroxypropyl cellulose.

Upon preparation of the dispersion, a dispersion stabilizer may be used as needed. Examples of the dispersion stabilizer include calcium phosphate and the like, which are soluble in acids or alkalis.

When calcium phosphate is employed as a dispersion stabilizer, the dispersion stabilizer can be removed rom particles by dissolving it in an acid such as hydrochloric acid, and by washing the particles with water or decomposing the dispersion stabilizer with oxygen.

Upon preparation of the dispersion it is possible to use a catalyst for the extension or crosslinking reaction. Examples of such a catalyst include dibutyl tin laurate and dioctyl tin laurate.

An organic solvent is removed from the resultant dispersion (emulsified slurry). Examples of the method of removing the organic solvent include (1) a method in which the reaction system is gradually heated to completely evaporate the organic solvent present in oil droplets, and (2) a method in which solid dispersions are sprayed in a dry atmosphere to completely remove a water-insoluble organic solvent in oil droplets to produce toner particles, along with evaporation of an aqueous dispersing agent.

After removal of the organic solvent, toner particles are formed. The toner particles may be further washed and dried. Subsequently, the toner particles may be optionally classified. Classification can be carried out by removing fine particles in the solution by cyclone, decantation, centrifugation, etc. Alternatively, classification may be carried out after dry toner particles are obtained as powder.

The toner particles thus obtained are mixed with such particles as the colorant, releasing agent, charge controlling agent, etc., and mechanical impact is applied thereto, thereby preventing particles such as the releasing agent from falling off the surfaces of the toner particles.

Examples of the method of applying mechanical impact include a method in which impact is applied to the mixture by means of a blade rotating at high speed, and a method in which impact is applied by introducing the mixture into a high-speed flow to cause particles collide with each other or to cause composite particles to collide against an impact board. Examples of a device employed for these method include angmill (manufactured by Hosokawamicron Corp.), modified I-type mill (manufactured by Nippon Pneumatic Mfg. Co., Ltd.) to decrease crushing air pressure, hybridization system (manufactured by Nara Machinery Co, Ltd.), krypton system (manufactured by Kawasaki Heavy Industries, Ltd.), and automatic mortars.

The color of the toner is not particularly limited and can be appropriately determined depending on the intended purpose; it is at least one of a black toner, cyan toner, magenta toner and yellow toner. Toners of different colors can be obtained by using different colorant accordingly; a color toner is preferable.

<Developer>

The developer used in the present invention comprises the toner of the present invention and appropriately selected additional ingredient(s) such as a carrier. The developer may be either a one-component or a two-component developer; however, when it is applied to high-speed printers that support increasing information processing rates of recent years, a two-component developer is preferable for the purpose of achieving an excellent shelf life.

In the case of a one-component developer comprising the toner of the present invention, variations in the toner particle diameter are minimized even after consumption or addition of toner, and toner filming to a developing roller and toner adhesion to members (e.g., blade) due to its reduced layer thickness are prevented. Thus, it is possible to provide excellent and stable developing properties and images even after a long time usage of the developing unit (i.e., after long time agitation of developer). Meanwhile, in the case of a two-component developer comprising the toner of the present invention, even after many cycles of consumption and addition of toner, the variations in the toner particle diameter are minimized and, even after a long time agitation of the developer in the developing unit, excellent and stable developing properties may be obtained.

The carrier is not particularly limited and can be appropriately selected depending on the intended purpose. However, the carrier is preferably selected from those having a core material and a resin layer coating the core material.

Materials for the core are not particularly limited and can be appropriately selected from conventional materials; for example, materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 emu/g to 120 emu/g) are preferable. In addition, weak magnetizing materials such as copper-zinc (Cu—Zn)-based materials (30 emu/g to 80 emu/g) are preferable from the standpoint for achieving higher-grade images by reducing the contact pressure against the photoconductor having standing toner particles. These materials may be used singly or in combination.

The particle diameter of the core material, in terms of volume-average particle diameter ($D_{50}$), is preferably 10 μm to 120 μm and, more preferably, 40 μm to 100 μm.

If the average particle diameter volume-average particle diameter ($D_{50}$)) is less than 10 μm, fine particles make up a large proportion of the carrier particle distribution, causing in some cases carrier splash due to reduced magnetization per one particle; on the other hand, if it exceeds 150 μm, the specific surface area of the particles decreases, causing toner splashes and reducing the reproducibility of images, particularly the reproducibility of solid-fills in full-color images.

Materials for the resin layer are not particularly limited and can be appropriately selected from conventional resins depending on the intended purpose; examples include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and non-fluoride monomers, and silicone resins. These resins may be used singly or in combination.

Examples of the amino resins include urea-formaldehyde resins, melamine resins, benzoguanamine resins, urea resins, polyamide resins, and epoxy resins. Examples of the polyvinyl resins include acrylic resins, polymethyl methacrylate resins, polyacrylonitrile resins, polyvinyl acetate resins, polyvinyl alcohol resins, and polyvinyl butyral resins. Examples of the polystyrene resins include polystyrene resins, and styrene-acryl copolymer resins. Examples of the halogenated olefin resins include polyvinyl chloride Examples of the polyester resins include polyethylene terephthalate resins, and polybutylene terephthalate resins.

The resin layer may contain such material as conductive powder depending on the application; for the conductive powder, metal powder, carbon black titanium oxide, tin oxide, zinc oxide, and the like are exemplified. These conductive powders preferably have an average particle diameter of 1 μm or less. If the average particle diameter is greater than 1 μm, it may be difficult to control electrical resistance.

The resin layer may be formed by dissolving the silicone resin or the like into a solvent to prepare a coating solution, uniformly coating the surface of the core material with the coating solution by a known coating process, and dying and baking the core material. Examples of the coating process include immersing process, spray process, and brush painting process.

The solvent is not particularly limited and can be appropriately determined depending on the intended purpose Examples include toluene, xylene, methyl ethyl ketone, methyl isobutyl ketone, cellusolve, and butylacetate.

The baking process may be an externally heating process or an internally heating process, and can be selected from for example, a process using a fixed type electric furnace, a fluid type electric furnace, a rotary type electric furnace or a burner furnace, and a process using microwave.

The content of the resin layer in the carrier is preferably 0.01% by mass to 5.0% by mass. If the content is less than 0.01% by mass it may be difficult to form a uniform resin layer on the surface of the core material, on the other hand, if the content exceeds 5.0% by mass, the resin layer becomes so thick that carrier particles may coagulate together. Thus, it may result in failure to obtain uniform carrier particles.

When the developer is a two-component developer, the content of the carrier in the two-component developer is not particularly limited and may be appropriately determined depending on the intended purpose; for example, it is preferably 90% by mass to 98% by mass, more preferably 93% by mass to 97% by mass.

In the case of a two-component developer, toner is generally mixed with carrier in an amount of 1 part by mass to 10 parts by mass per 100 parts by mass of carrier.

Since the developer of the present invention comprises the toner of the present invention, it allows toner particles to be densely packed in a toner image, can provide high-definition images with reduced image layer thickness, and can achieve long-term stable removability.

The developer can be suitably applied to a variety of known electrophotographic image formation processes including a magnetic one-component developing process, non-magnetic one-component developing process, and two-component developing process, particularly to a toner container, process cartridge, image forming apparatus and image forming method of the present invention, all of which will be described below (Toner Container)

The toner container of the present invention is a container supplied with the toner or developer of the present invention.

The toner container is not particularly limited and can be appropriately selected from conventional containers; for example, a toner container having a container main body and a cap is a suitable example.

The size, shape, structure material and other several features of the container main body is not particularly limited and can be appropriately determined depending on the intended purpose. For example, the container main body preferably has a cylindrical shape, most preferably a cylindrical shape in which spiral grooves are formed on its inner surface that allow toner in the container to shift to the outlet along with rotation of the main body, and in which all or part of the spiral grooves have a bellow function.

Materials for the container main body are not particularly limited and are preferably those capable of providing accurate dimensions when fabricated; examples include resins. For example, polyester resins, polyethylene resins, polypropylene resins, polystyrene resins, polyvinyl chloride resins, polyacrylic acid resins, polycarbonate resins, ABS resins, and polyacetal resins are suitable examples.

The toner container of the present invention can be readily stored and transferred, and is easy to handle. The toner container can be suitably used for the supply of toner by detachably attaching it to a process cartridge, image forming apparatus, etc., of the present invention to be described later.

(Process Cartridge)

The process cartridge of the present invention comprises a latent electrostatic image bearing member configured to bear a latent electrostatic image, and a developing unit configured to develop the latent electrostatic image formed on the latent electrostatic image bearing member using a developer to thereby form a visible image, and further comprises additional unit(s) appropriately selected.

The developing unit comprises a developer container for storing the toner or developer of the present invention, and a developer carrier for carrying and transferring the toner or developer stored in the developer container, and may further comprises a layer-thickness control member for controlling the thickness of the layer of toner to be carried.

The process cartridge of the present invention can be detachably attached to various electrophotographic apparatus, faxes, and printers, particularly to the image forming apparatus of the present invention to be described later.

Figure 4:
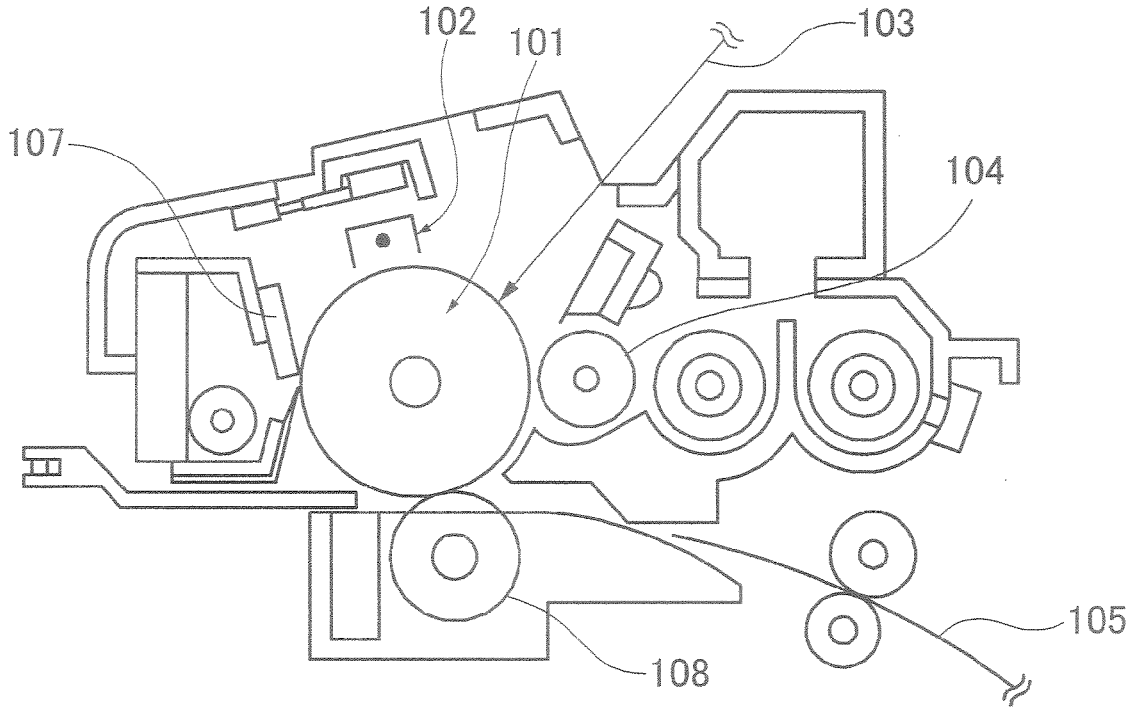
FIG. 4 is a schematic view showing an example of the process cartridge of the present invention.

The process cartridge of the present invention comprises, for example, as shown in FIG. 4, a built-in photoconductor 101, a charging unit 102, a developing unit 104 and a cleaning unit 107 and, if necessary, further comprises additional unit(s).

For the photoconductor 101, a photoconductor similar to that described above can be used.

For an exposure unit 103, a light source capable of high-definition exposure is used.

For the charging unit 102, an arbitrary charging member can be used.

The image forming apparatus of the present invention comprises the latent electrostatic image bearing member, developing device, cleaning device, etc., which are integrated into a process cartridge. This unit may be detachably attached to the apparatus itself. Alternatively, at least one of a charging device, exposing device, developing device and transferring or separating device are supported together with the latent electrostatic image bearing member to form a process cartridge, thus forming a single unit that can be detachably attached to the apparatus by means of guide means (e.g., rails) provided in the apparatus.

(Image Formation Method and Image Formation Apparatus)

The image forming apparatus of the present invention comprises an latent electrostatic image bearing member, a latent electrostatic image forming unit, a developing unit, a transferring unit and a fixing unit, and further comprises additional unit(s) such as a charge eliminating unit, a cleaning unit, a recycling unit and a controlling unit, which are optionally selected as needed.

The image forming method of the present invention comprises a latent electrostatic image forming step, a developing step, a transferring step and a fixing step, and further comprises additional step(s) such as a charge removing step, a cleaning step, a recycling step and/or a controlling step, which are optionally selected as needed.

The image forming method of the present invention can be suitably performed using the image forming apparatus of the present invention. The latent electrostatic image forming step is performed by the latent electrostatic image forming unit, the developing step is performed by the developing unit, the transferring step is performed by the transferring unit, the fixing step is performed by the fixing unit, and the additional steps can be performed by the additional units.

—Latent Electrostatic Image Forming Step and Latent Electrostatic Image Forming Unit—

The latent electrostatic image forming step is a step of forming a latent electrostatic image on a latent electrostatic image bearing member.

The material, shape, size, structure, and several features of the latent electrostatic image bearing member (referred to as "photoconductor" or "electrophotographic photoconductor" in some cases) are not particularly limited. The latent electrostatic image bearing member can be appropriately selected from those known in the art. However, a drum shaped-latent electrostatic image bearing member is a suitable example. For the material constituting the latent electrostatic image bearing member, inorganic photoconductive materials such as amorphous silicon and selenium, and organic photoconductive materials such as polysilane and phthalopolymethine are preferable. Among these, amorphous silicon is preferable in view of its long life.

The formation of the latent electrostatic image is achieved by, for example, exposing the latent electrostatic image bearing member imagewisely after equally charging its entire surface. This step is performed by means of the latent electrostatic image forming unit.

The latent electrostatic image forming unit comprises a charging device configured to equally charge the surface of the latent electrostatic image bearing member, and an exposing device configured to imagewisely expose the surface of the latent electrostatic image bearing member.

The charging step is achieved by, for example, applying voltage to the surface of the latent electrostatic image bearing member by means of the charging device.

The charging device is not particularly limited and can be appropriately selected depending on the intended purpose; examples include known contact-charging devices equipped with a conductive or semiconductive roller, blush, film or rubber blade; and known non-contact-charging devices utilizing corona discharge such as corotron or scorotoron.

The exposure step is achieved by, for example, selectively exposing the surface of the photoconductor by means of the exposing device.

The exposing device is not particularly limited as long as it is capable of performing image-wise exposure on the surface of the charged latent electrostatic image bearing member by means of the charging device, and may be appropriately selected depending on the intended use; examples include various exposing devices, such as optical copy devices, rod-lens-eye devices, optical laser devices and optical liquid crystal shatter devices.

Note in the present invention that a backlight system may be employed for exposure, where image-wise exposure is performed from the back side of the latent electrostatic image bearing member.

—Developing and Developing Unit—

The developing step is a step of developing the latent electrostatic image using the toner or developer of the present invention to form a visible image.

The formation of the visible image can be achieved, for example, by developing the latent electrostatic image using the toner or developer of the present invention. This is performed by means of the developing unit.

The developing unit is not particularly limited as long as it is capable of development by means of the toner or developer of the present invention, and can be appropriately selected from known developing units depending on the intended purpose; suitable examples include those having at least a developing device, which is capable of housing the toner or developer of the present invention therein and is capable of directly or indirectly applying the toner or developer to the latent electrostatic image. A developing device equipped with the toner container of the present invention is more preferable.

The developing device may be of dry developing type or wet developing type, and may be designed either for monochrome or multiple-color; suitable examples include those having an agitation unit for agitating the toner or developer to provide electrical charges by frictional electrification, and a rotatable magnet roller.

In the developing device the toner and carrier are mixed together and the toner is charged by friction, allowing the rotating magnetic roller to bear toner particles in such a way that they stand on its surface. In this way a magnetic blush is formed. Since the magnet roller is arranged in the vicinity of the latent electrostatic image bearing member (photoconductor), some toner particles on the magnetic roller that constitute the magnetic blush electrically migrate to the surface of the latent electrostatic image bearing member (photoconductor). As a result, a latent electrostatic image is is developed by means of the toner, forming a visible image, or a toner image, on the surface of the latent electrostatic image bearing member (photoconductor).

—Transferring and Transferring Unit—

The transferring step is a step of transferring the visible image to a recording medium. A preferred embodiment of transferring involves two steps: primary transferring in which the visible image is transferred to an intermediate transferring medium; and secondary transferring in which the visible image transferred to the intermediate transferring medium is transferred to a recording medium. A more preferable embodiment of transferring involves two steps: primary transferring in which a visible image is transferred to an intermediate transferring medium to form a complex image thereon by means of toners of two or more different colors, preferably full-color toners; and secondary transferring in which the complex image is transferred to a recording medium.

The transferring step is achieved by, for example, charging the latent electrostatic image bearing member (photoconductor) by means of a transfer charging unit. This transferring step is performed by means of the transferring unit. A preferable embodiment of the transferring unit has two units: a transferring unit configured to transfer a visible image to an intermediate transferring medium to form a complex image; and a secondary transferring unit configured to transfer the complex image to a recording medium.

The intermediate transferring medium is not particularly limited and can be selected from conventional transferring media depending on the intended purpose; suitable examples include transferring belts.

The transferring unit (i.e., the primary and secondary transferring units) preferably comprises a transferring device configured to charge and separate the visible image from the latent electrostatic image bearing member (photoconductor) and transfer it to the recording medium. The number of the transferring device to be provided may be either 1 or more.

Examples of the transferring device include corona transferring devices utilizing corona discharge, transferring belts, transferring rollers, pressure-transferring rollers, and adhesion-transferring devices.

The recording medium is generally standard paper and can be appropriately determined depending on the intended purpose as long as it is capable of receiving developed, unfixed image thereon. PET bases for OHP can also be used.

The fixing step is a step of fixing a transferred visible image to a recording medium by means of the fixing unit. Fixing may be performed every time after each different toner has been transferred to the recording medium or may be performed in a single step after all different toners have been transferred to the recording medium.

The fixing unit is not particularly limited and can be appropriately selected depending on the intended purpose; examples include a heating-pressurizing unit. The heating-pressurizing unit is preferably a combination of a heating roller and a pressurizing roller, or a combination of a heating roller, a pressurizing roller, and an endless belt, for example In general, heating treatment by means of the heating-pressurizing unit is preferably performed at a temperature of 80° C. to 200° C.

Note in the present invention that a known optical fixing unit may be used in combination with or instead of the fixing step and fixing unit, depending on the intended purpose.

The charge removing step is a step of applying a bias to the charged electrophotographic photoconductor for removal of charges. This is suitably performed by means of the charge eliminating unit.

The charge removing unit is not particularly limited as long as it is capable of applying a charge removing bias to the latent electrostatic image bearing member, and can be appropriately selected from conventional charge eliminating units depending on the intended purpose. A suitable example thereof is a charge removing lamp and the like.

The cleaning step is a step of removing toner particles remained on the latent electrostatic image bearing member. This is suitably performed by means of the cleaning unit.

The cleaning unit is not particularly limited as long as it is capable of removing such toner particles from the latent electrostatic image bearing member, and can be suitably selected from conventional cleaners depending on the intended use; examples include a magnetic blush cleaner, a electrostatic brush cleaner, a magnetic roller cleaner, a blade cleaner, a blush cleaner, and a wave cleaner.

The recycling step is a step of recovering the toner particles removed through the cleaning step to the developing unit. This is suitably performed by means of the recycling unit.

The recycling unit is not particularly limited, and can be appropriately selected from conventional conveyance systems.

The controlling step is a step of controlling the foregoing steps. This is suitably performed by means of the controlling unit.

The controlling unit is not particularly limited as long as the operation of each step can be controlled, and can be appropriately selected depending on the intended use. Examples thereof include equipment such as sequencers and computers.

One embodiment of the image forming method of the present invention by means of the image forming apparatus of the present invention will be described with reference to FIG. 5. An image forming apparatus 100 shown in FIG. 5 comprises a photoconductor drum 10 (hereinafter referred to as a photoconductor 10) as the latent electrostatic image bearing member, a charging roller 20 as the charging unit, an exposure device 30 as the exposing unit, a developing device 40 as the developing unit, an intermediate transferring member 50, a cleaning device 60 having a cleaning blade as the cleaning unit, and a charge removing lamp 70 as the charge removing unit.

The intermediate transferring member 50 is an endless belt, and is so designed that it loops around three rollers 51 disposed its inside and rotates in the direction shown by the arrow by means of the rollers 51. One or more of the three rollers 51 also functions as a transfer bias roller capable of applying a certain transfer bias (primary bias) to the intermediate transferring member 50. The cleaning device 60 having a cleaning blade is provided adjacent to the intermediate transferring member 50. There is provided a transferring roller 80 next to the intermediate transferring member 50 as the transferring unit capable of applying a transfer bias to transfer a developed image (toner image) to a transfer sheet 95, a recording medium (secondary transferring). Moreover, there is provided a corona charger 58 around the intermediate transferring member 50 for applying charges to the toner image transferred on the intermediate transferring medium 50. The corona charger 58 is arranged between the contact region of the photoconductor 10 and the intermediate transferring medium 50 and the contact region of the intermediate transferring medium 50 and the transfer sheet 95.

The developing device 40 comprises a developing belt 41 (a developer bearing member), a black developing unit 45K, yellow developing unit 45Y, magenta developing unit 45M and cyan developing unit 45C, the developing units being positioned around the developing belt 41. The black developing unit 45K comprises a developer container 42K, a developer supplying roller 43K, and a developing roller 44K. The yellow developing unit 45Y comprises a developer container 42Y, a developer supplying roller 43Y, and a developing roller 44Y. The magenta developing unit 45M comprises a developer container 42M, a developer supplying roller 43Y, and a developing roller 44M. The cyan developing unit 45C comprises a developer container 42C, a developer supplying roller 43C, and a developing roller 44C. The developing belt 41 is an endless belt looped around a plurality of belt rollers so as to be rotatable. A part of the developing belt 41 is in contact with the latent electrostatic image bearing member 10.

Figure 5:
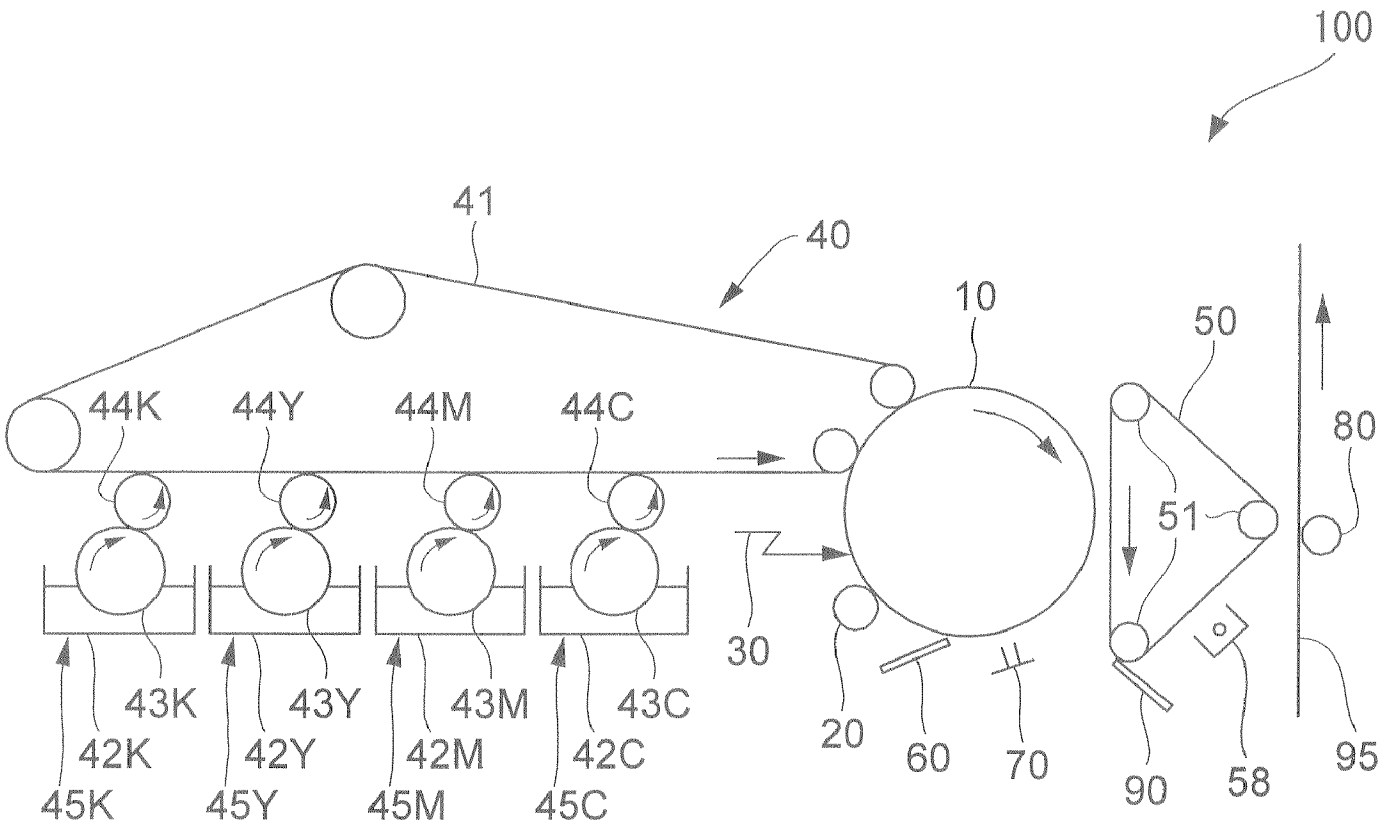
FIG. 5 is a schematic view showing an example of carrying out the image forming method of the present invention by means of the image forming apparatus of the present invention.

In the image forming apparatus 100 shown in FIG. 5, the photoconductor drum 10 is uniformly charged by means of, for example, the charging roller 20. The exposure device 30 then applies a light beam to the photoconductor drum 10 so as to form a latent electrostatic image. The latent electrostatic image formed on the photoconductor drum 10 is provided with toner from the developing device 40 to form a visible image (toner image). The roller 51 applies a bias to the toner image to transfer the visible image (toner image) to the intermediate transferring medium 50 (primary transferring), and the toner image is then transferred to the transfer sheet 95 (secondary transferring). In this way a transferred image is formed on the transfer sheet 95. Thereafter, toner particles remained on the photoconductor drum 10 are removed by means of the cleaning device 60, and charges of the photoconductor drum 10 are removed by means of the charge removing lamp 70 on a temporary basis.

Figure 6:
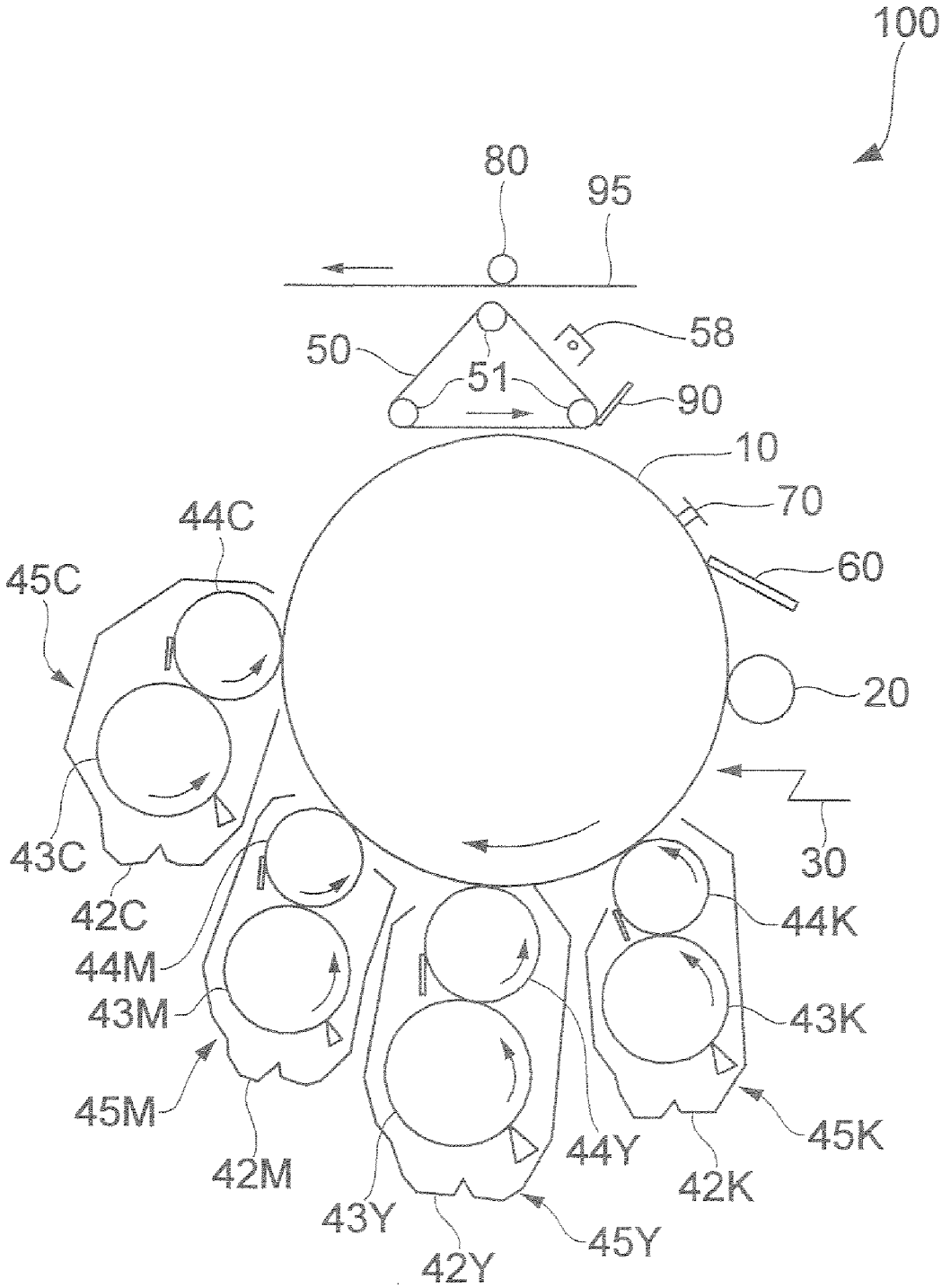
FIG. 6 is a schematic view showing another example of carrying out the image forming method of the present invention by means of the image forming apparatus of the present invention.

Another embodiment of the image forming method of the present invention by means of the image forming apparatus of the present invention will be described with reference to FIG. 6. The image forming apparatus 100 shown in FIG. 6 has an identical configuration and working effects to those of the image forming apparatus 100 shown in FIG. 5 except that this image forming apparatus 100 does not comprise the developing belt 41 and that the black developing unit 45K, yellow developing unit 45Y, magenta developing unit 45M and cyan developing unit 45C are disposed around the periphery of the photoconductor 10. Note in FIG. 6 that members identical to those in FIG. 5 are denoted by the same reference numerals.

Figure 7:
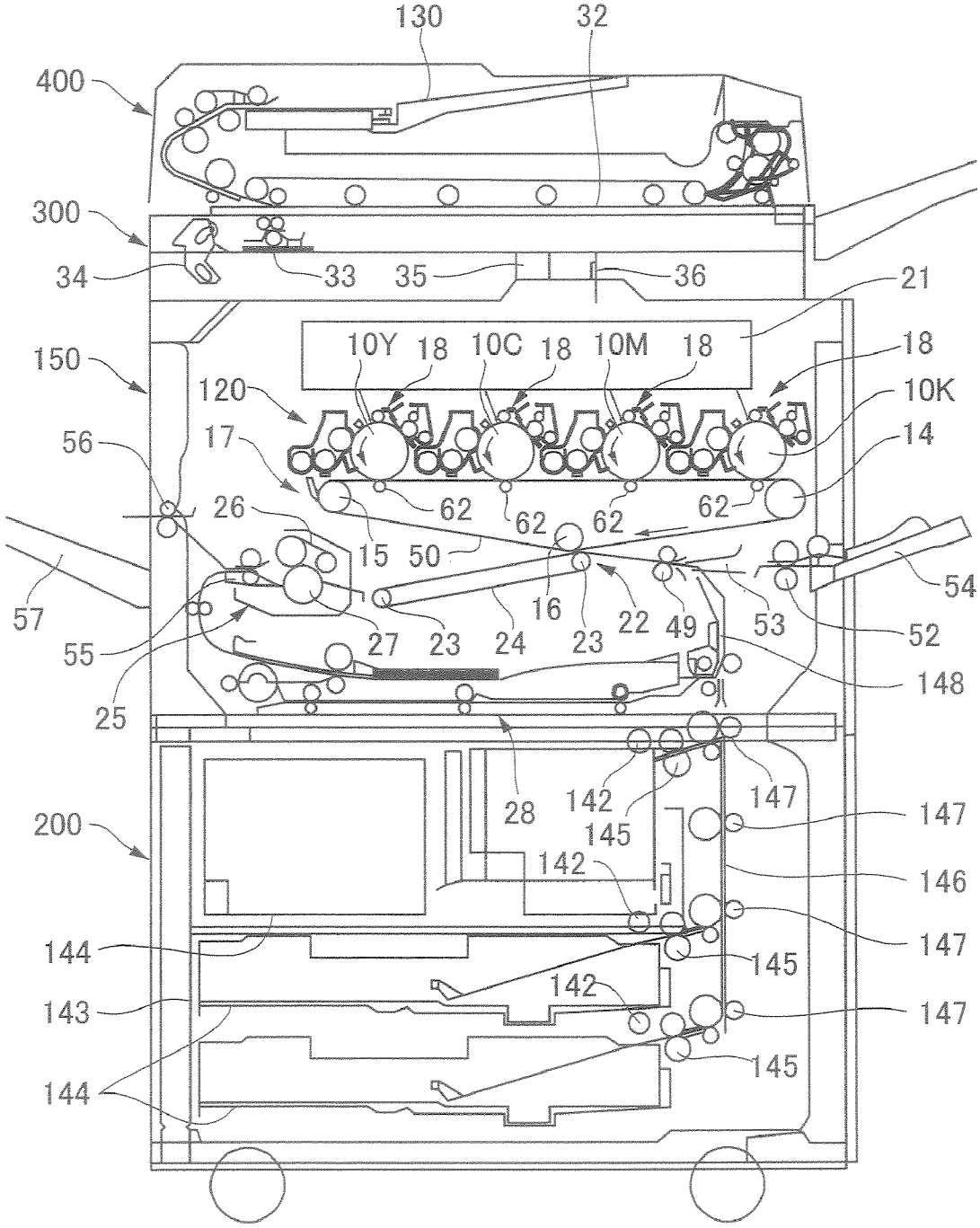
FIG. 7 is a schematic view showing an example of carrying out the image forming method of the present invention by means of the image forming apparatus of the present invention (a tandem color-mage forming apparatus).

Still another embodiment of the image forming method of the present invention by means of the image forming apparatus of the present invention will be described with reference to FIG. 7. An image forming apparatus 100 shown in FIG. 7 is a tandem color image-forming apparatus. The tandem image forming apparatus comprises a copy machine main body 150, a feeder table 200, a scanner 300, and an automatic document feeder (ADF) 400.

The copy machine main body 150 has an endless-belt intermediate transferring member 50 in the center. The intermediate transferring member 50 is looped around support rollers 14, 15 and 16 and is configured to rotate in a clockwise direction in FIG. 7. A cleaning device 17 for the intermediate transferring member is provided in the vicinity of the support roller 15. The cleaning device 17 removes toner particles remained on the intermediate transferring member 50. On the intermediate transferring member 50 looped around the support rollers 14 and 16, four color-image forming devices 18—yellow, cyan, magenta, and black—are arranged, constituting a tandem developing unit 120. An exposing unit 21 is arranged adjacent to the tandem developing unit 120. A secondary transferring unit 22 is arranged across the intermediate transferring member 50 from the tandem developing unit 120. The secondary transferring unit 22 comprises a secondary transferring belt 24, an endless belt, which is looped around a pair of rollers 23. A paper sheet on the secondary transferring belt 24 is allowed to contact the intermediate transferring member 50. An image fixing device 25 is arranged in the vicinity of the secondary transferring unit 22. The image fixing device 25 comprises a fixing belt 26, an endless belt, and a pressurizing roller 27 which is pressed by the fixing belt 26.

In the tandem image forming apparatus, a sheet reverser 28 is arranged adjacent to both the secondary transferring unit 22 and the image-fixing device 25. The sheet reverser 28 turns over s a transferred sheet to form images on the both sides of the sheet.

Next, full-color image formation (color copying) using the tandem developing unit will be described. At first, a source document is placed on a is document tray 130 of the automatic document feeder 400. Alternatively, the automatic document feeder 400 is opened, the source document is placed on a contact glass 32 of a scanner 300, and the automatic document feeder 400 is closed.

When a start switch (not shown) is pushed, the source document placed on the automatic document feeder 400 is transferred to the contact glass 32, and the scanner is then driven to operate first and second carriages 33 and 34. In a case where the source document is originally placed on the contact glass 32, the scanner 300 is immediately driven after pushing of the start switch. A light beam is applied from a light source to the document by means of the first carriage 33, and the light beam reflected from the document is further reflected by the mirror of the second carriage 34. The reflected light beam passes through an image-forming lens 35, and a read sensor 36 receives it. In this way the color document (color image) is scanned, producing 4 types of color information—black, yellow, magenta, and cyan.

Figure 8:
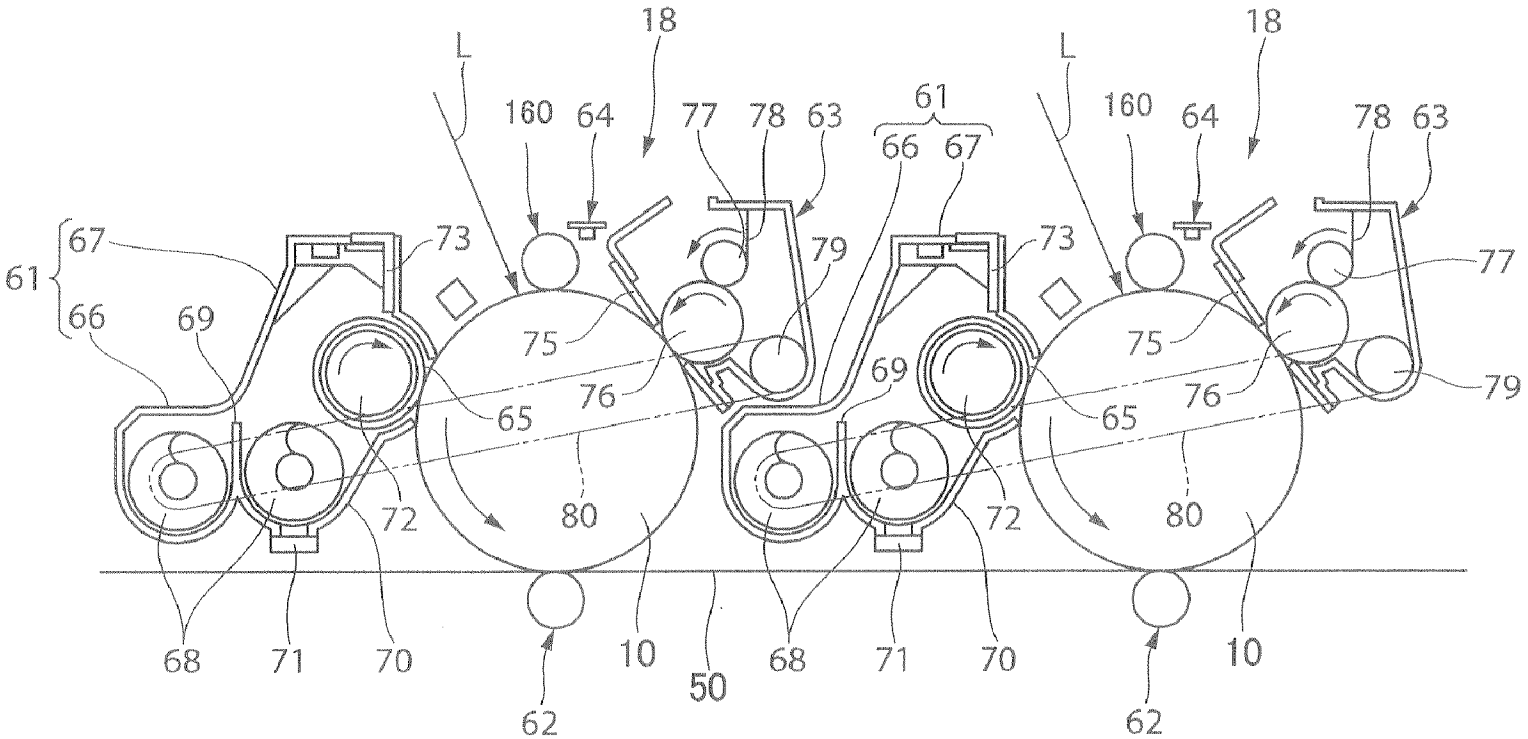
FIG. 8 is a partially enlarged schematic view of the image forming apparatus of FIG. 7.

Each piece of color information (black, yellow, magenta, and cyan) is transmitted to the image forming unit 18 (black image forming unit, yellow image forming unit, magenta image forming unit, or cyan image forming unit) of the tandem developing unit 120, and toner images of each color are formed in the image-forming units 18. As shown in FIG. 8, each of the image-forming units 18 (black image-forming unit yellow image forming unit, magenta image forming unit, and cyan image forming unit) of the tandem developing unit 120 comprises: a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charging device 160 for uniformly charging the latent electrostatic image bearing member; an exposing unit for forming a latent electrostatic image corresponding to the color image on the latent electrostatic image bearing member by exposing it to light (denoted by "L" in FIG. 8) on the basis of the corresponding color image information; a developing device 61 for developing the latent electrostatic image using the corresponding color toner (black toner, yellow toner, magenta toner, or cyan toner) to form a toner image; a transfer charger 62 for transferring the toner image to the intermediate transferring member 50; a cleaning device 63; and a charge removing device 64. Thus, images of different colors (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred to the intermediate transferring member 50 which rotates by means of support rollers 14, 15 and 16 (primary transferring). These toner images are overlaid on the intermediate transferring member 50 to form a composite color image (color transferred image).

Meanwhile, one of feed rollers 142 of the feed table 200 is selected and rotated, whereby sheets (recording sheets) are ejected from one of multiple feed cassettes 144 in the paper bank 143 and are separated one by one by a separation roller 145. Thereafter, the sheets are fed to a feed path 146, transferred by a transfer roller 147 into a feed path 148 inside the copying machine main body 150, and are bumped against a resist roller 49 to stop. Alternatively, one of the feed rollers 142 is rotated to eject sheets (recording sheets) placed on a manual feed tray 54. The sheets are then separated one by one by means of a separation roller 52, fed into a manual feed path 53, and similarly, bumped against the resist roller 49 to stop. Note that the resist roller 49 is generally earthed, but may be biased for removing paper dusts on the sheets.

The resist roller 49 is rotated synchronously with the movement of the composite color image on the intermediate transferring member 50 to transfer the sheet (recording sheet) into between the intermediate transferring member 50 and the secondary transferring unit 22, and the composite color image is transferred to the sheet by means of the secondary transferring unit 22 (secondary transferring). In this way the color image is formed on the sheet. Note that after image transferring, toner particles remained on the intermediate transferring member 50 are removed by means of the cleaning device 17.

The sheet (recording sheet) bearing the transferred color image is conveyed by the secondary transferring unit 22 into the image fixing device 25, where the composite color image (color transferred image) is fixed to the sheet (recording sheet) by heat and pressure. Thereafter the sheet changes its direction by action of a switch hook 55, ejected by an ejecting roller 56, and stacked on an output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

Since the image forming method and image forming apparatus of the present invention uses the toner of the present invention, which the toner allows toner particles to be densely packed n a toner image, can provide high-definition images with reduced image layer thickness and can achieve long-term stable removability, it is possible to form sharp, high-quality images.

Hereinafter Examples of the present invention will be described, which however shall not be construed as limiting the invention thereto. It should be noted that "part(s)" means "part(s) by mass" unless otherwise noted.

EXAMPLE 1

—Synthesis of Emulsion of Organic Particles—

A reaction vessel equipped with a stirrer and a thermometer was charged with 683 parts of water, 11 parts of a sodium salt of sulfuric acid ester of ethylene oxide adduct of methacrylic acid (Eleminol RS-30, produced by Sanyo Chemical Industries Co), 83 parts of styrene, 83 parts of methacrylic acid, 110 parts of butyl acrylate, and 1 part of ammonium persulfate, followed by agitation for 15 minutes at 400 rpm to produce a white liquid emulsion. The inside of the reaction vessel was heated to 75° C. for 5 hours for reaction. To the reaction vessel was added 30 parts of a 1% aqueous solution of ammonium persulfate, and the reaction vessel was allowed to stand for 5 hours at 75° C. to produce an aqueous dispersion of vinyl resin (a copolymer consisting of styrene, methacrylic acid, butyl acrylate, and sodium salt of sulfuric acid ester of ethylene oxide adduct of methacrylic acid)—Particle Dispersion 1.

The volume-average particle diameter of Particle Dispersion 1 measured using a laser diffraction particle size analyzer (LA-920, SHIMADZU Corp.) was 105 nm. In addition, an aliquot of Particle Dispersion 1 was dried to isolate a resin component. The glass transition temperature (Tg) of the resin component was determined to be 59° C., and its weight-average molecular weight (Mw) was determined to be 150,000.

—Preparation of Aqueous Phase—

For preparation of an aqueous phase, 990 parts of water, 99 parts of Particle Dispersion 1, 35 parts of a 48.5% aqueous solution of sodium dodecyldiphenylether disulfonate (Eleminol MON-7, produced by Sanyo Chemical Industries Co.), and 60 parts of ethyl acetate were mixed to produce a creamy white liquid. This was used as Aqueous Phase 1.

—Synthesis of Low Molecular Polyester—

A reaction vessel equipped with a condenser tube, a stirrer and a nitrogen gas inlet tube was charged with 229 parts of 2 mole ethylene oxide adduct of bisphenol A, 529 parts of 3 mole propylene oxide adduct of bisphenol A, 208 parts of terephthalic acid, 46 parts of adipic acid, and 2 parts of dibutyl tin oxide, allowing reaction to take place for 8 hours at 230° C. under normal pressure. The reaction was continued for a further 5 hours under reduced pressure (10-15 mmHg). Thereafter, 44 parts of anhydride trimellitic acid was added to the reaction vessel to allow reaction to take place for 1.8 hour at 180° C. under normal pressure. In this way Low Molecular Polyester 1 was synthesized.

Low Molecular Polyester 1 thus obtained had a number-average molecular weight (Mn) of 2,500, weight-average molecular weight (Mw) of 6,700, peak molecular weight of 5,000, glass transition temperature (Tg) of 43° C., and acid value of 25.

—Synthesis of Intermediate Polyester—

A reaction vessel equipped with a condenser tube, a stirrer and a nitrogen gas inlet tube was charged with 682 parts of 2 mole ethylene oxide adduct of bisphenol A, 81 parts of 2 mole propylene oxide adduct of bisphenol A, 283 parts of terephthalic acid, 22 parts of anhydride trimellitic acid, and 2 parts of dibutyl tin oxide, allowing reaction to take place for 8 hours at 230° C. under normal pressure. The reaction was continued for a further 5 hours under reduced pressure (10-15 mmHg) to produce Intermediate Polyester 1.

Intermediate Polyester 1 thus obtained had a number-average molecular weight (Mn) of 2,100, weight-average molecular weight (Mw) of 95.00, glass transition temperature (Tg) of 55° C., acid value of 5, and hydroxyl value of 51.

Subsequently, a reaction vessel equipped with a condenser tube, a stirrer and a nitrogen inlet tube was charged with 410 parts of Intermediate Polyester 1, 89 parts of isophorone diisocyanate, and 500 parts of ethyl acetate, allowing reaction to take place for 5 hours at 100° C. to produce Prepolymer 1.

The content of free isocyanates in Prepolymer 1 was 1.53% by mass.

—Synthesis of Ketimine Compound—

A reaction vessel equipped with a stirrer and a thermometer was charged with 170 parts of isophorone diamine and 75 parts of methyl ethyl ketone, allowing reaction to take place for 5 hours at 50° C. to produce Ketimine Compound 1.

The amine value of Ketimine Compound 1 thus obtained was 418.

—Preparation of Master Batch—

Using HENSCHEL MIXER (Mitsui Mining Company, Ltd.), 1200 parts of water, 540 parts of carbon black (Printex 35, produced by Degussa Corp. DBP absorption=42 ml 100 mg, pH=9.5), and 1200 parts of polyester resin were mixed, and further kneaded for 30 minutes at 150° C. using a double roll. Thereafter the resultant paste was extended by applying pressure, cooled, and pulverized in a pulverizer to produce Master Batch 1.

—Preparation of Oil Phase—

A reaction vessel equipped with a stirrer and a thermometer was charged with 378 parts of Low Molecular Polyester 1, 110 parts of carnauba wax, 32 parts of a charge controlling agent (E-84, zinc salicylate, produced by Orient Chemical Industries, Ltd.), and 947 parts of ethyl acetate, heated to 80° C. with agitation, retained for 5 hours at 80° C., and cooled to 30° C. in 1 hour. Subsequently, 500 parts of Master Batch 1 and 500 parts of ethyl acetate were added to the reaction vessel, and stirred for 1 hour to produce Toner Constituent Solution 1.

Next, 1324 parts of Toner Constituent Solution 1 thus obtained was transferred to a reaction vessel, and dispersed using a bead mill (ULTRAVISCOMILL, manufactured by AIMEX Co., Ltd.) under the following conditions: Liquid feeding speed=1 kg/hr, Disc rotation speed=6 m/sec, Diameter of beads=0.5 mm, Filling factor=80% by volume, and the number of dispersing operations=3.

In this way the carbon black and wax were dispersed. Subsequently, 1324 parts of a 65% ethyl acetate solution of Low Molecular Polyester 1 was added to the reaction vessel, followed by another dispersion operation using the bead mill under the foregoing conditions. Thus, Pigment/Wax Dispersion 1 was obtained.

The proportion of solids in Pigment/Wax Dispersion 1 was 50% by mass, when measured after heated to 130° C. for 30 minutes.

—Emulsification and Solvent Removal Step—

To a reaction vessel was added 749 parts of Pigment/Wax Dispersion 1, 115 parts of Prepolymer 1, and 2.9 parts of Ketimine Compound 1. Furthermore, 2.0 parts of the solids of an organosilica sol (MEK-ST-UP, produced by Nissan Chemical Industries, Ltd.) was added to the reaction vessel and, using a TK homomixer, mixed for 1 minute at 5,000 rpm. Thereafter 1250 parts of Aqueous Phase 1 was added and mixed using the TK homomixer for 30 minutes at 12,500 rpm, producing Emulsion Slurry 1.

A reaction vessel equipped with a stirrer and a thermometer was charged with Emulsion Slurry 1, and heated to 40° C. for 5 hours for the removal of a solvent. The slurry was then allowed to stand for 4 hours at 45° C. to produce Dispersion Slurry 1.

—Washing and Drying—

One hundred parts of Dispersion Slurry 1 was filtrated under reduced pressure, and the filter cake was added to 100 parts of deionized water and mixed using the TK homomixer for 10 minutes at 12,000 rpm followed by filtration.

Next, the resultant filter cake was added to 100 parts of a 10% (by mass) aqueous solution of sodium hydroxide and mixed using the TK homomixer for 30 minutes at 12,000 rpm followed by filtration under reduced pressure.

The resultant filter cake was added to 100 parts of a 10% (by mass) aqueous solution of hydrochloric acid and mixed using the TK homomixer for 10 minutes at 12,000 rpm followed by filtration.

The resultant filter cake was added to 300 parts of deionized water and mixed using the TK homomixer for 10 minutes at 12,000 rpm followed by filtration (this procedure was performed twice). In this way Filter Cake 1 was obtained.

Filter Cake 1 was dried for 48 hours at 45° C. in a circulating drier and sieved through 75 μm mesh to produce Toner 1.

—Addition of External Additive—

To 100 parts of Toner 1 was added 1.5 parts of hydrophobic silica and mixed using HENSCHEL MIXER to produce toner of Example 1

EXAMPLE 2

Toner of Example 2 was prepared in a manner similar to that described in Example 1 except that 2.5 parts of the solids of an organosilica sol was used in the emulsification and solvent removal step.

EXAMPLE 3

Toner of Example 3 was prepared in a manner similar to that described in Example 1 except that 3.5 parts of the solids of an organosilica sol was used in the emulsification and solvent removal step.

EXAMPLE 4

Toner of Example 4 was prepared in a manner similar to that described in Example 1 except that 4.5 parts of the so ids of an organosilica sol was used in the emulsification and solvent removal step.

COMPARATIVE EXAMPLE 1

Toner of Comparative Example 1 was prepared in a manner similar to that described in Example 1 except that no organosilica sol was added to the toner in the emulsification and solvent removal step.

COMPARATIVE EXAMPLE 2

Through wet pulverization, toner of Comparative Example 2 was prepared in the following manner using polyester resin synthesized from bisphenol diol and a polycarboxylic acid.

At first, 86 parts of polyester resin (number-average molecular weight (Mn)=6,000, weight-average molecular weight (Mw)=50,000, and glass transition temperature (Tg)=61° C.), 10 parts of rice wax (acid value=0.5), and 4 parts of copper phthalocyanine blue pigment (produced by TOYO INK Corp) were fully mixed using HENSCHEL MIXER, heated and melted using a roll mill for 40 hours at 80° C. to 110° C., and cooled to room temperature. The resultant paste was pulverized and classified to produce toner particles Using HENSCHEL MIXER 1.5 parts of hydrophobic silica was mixed with 100 parts of the toner particles to prepare toner of Comparative Example 2.

For the toners prepared in Examples 1 to 4 and Comparative Examples 1 and 2, the surface factors SF-1 and SF-2, small diameter SF-2, large diameter SF-2, porosity, toner particle diameter (Dv, Dv/Dn), proportion of toner particles with a circle equivalent diameter of 2 μm or less, and presence of an inorganic oxide particle layer were determined. The results are shown in Table 1.

<Surface Factors SF-1 and SF-2>

Pictures of toner particles were taken by a scanning electron microscope (S-800, manufactured by Hitachi Ltd.) and analyzed by an image analyzer (LUSEX3, manufactured by NIRECO Corp.) calculating the surface factors SF-1 and SF-2 using the following Equations (1) and (2).

$$SF\text{-}1=[(MXLNG)^2/\text{AREA}]\times(100\pi/4) \quad \text{Equation (1)}$$

where MXLNG represents the maximum length across a two-dimensional projection of a toner particle, and AREA represents the area of the projection $$SF\text{-}2=[(PERI)^2/\text{AREA}]\times(100/4\pi) \quad \text{Equation (2)}$$

where PERI represents the perimeter of a two-dimensional projection of a toner particle, and AREA represents the area of the projection <The Proportion of Toner Particles with a Circle Equivalent Diameter of 2 μm or Less>

The proportion (number %) of toner particles with a given circle equivalent diameter can be determined using a flow particle image analyzer (FPIA-2100, manufactured by Sysmex Corp.). More specifically, 1% NaCl aqueous solution was prepared using primary sodium chloride, and filtrated through a 0.45 μm pore size filter. To 50-100 ml of this solution was added 0.1-5 ml of a surfactant (preferably alkylbenzene sulfonate) as a dispersing agent, followed by addition of 1-10 mg of sample. The mixture was then sonicated for 1 minute using an ultrasonicator to prepare a dispersion with a final particle concentration of 5,000-15,000/μL for measurement. Measurement was made on the basis of a circle equivalent diameter—the diameter of a circle having the same area as the 2D image of a toner particle taken by a CCD camera. In view of resolution of the CCD camera, measurement data were collected from particles with a circle equivalent diameter of 0.6 μm or more.

<The Porosity of Toner Particles>

Using a porosity measurement device shown in FIG. 3 the volume and mass of toner packed under pressure of 10 kg/cm$^2$ were measured, calculating the porosity of toner particles with their specific gravity previously measured taken into account.

<Toner Particle Diameter>

The volume-average particle diameter (Dv) and number-average particle diameter (Dn) of toner particles were measured using a particle size analyzer (Multisizer II, Beckmann Coulter Inc.) at an aperture diameter of 100 μm, determining the particle size distribution (Dv/Dn) of the toner particles.

<Presence of an Inorganic Oxide Particle Layer>

Whether or not an inorganic oxide particle layer is present within 1 μm from the surface of a toner particle was determined by observing a cross section of the toner particle using a transmission electron microscope (TEM).

TABLE 1

| | SF-1 | SF-2 | Small diameter SF-2/Large diameter SF-2 | Porosity | Dv | Dv/Dn | Presence of inorganic oxide particle-containing layer | Proportion of toner particles with a circle equivalent diameter of 2 μm or less |
|---|---|---|---|---|---|---|---|---|
| Ex. 1 | 128 | 126 | 128/144 | 54% | 5.2 μm | 1.16 | Yes | 5.9% |
| Ex. 2 | 131 | 127 | 128/158 | 56% | 5.6 μm | 1.18 | Yes | 6.4% |
| Ex. 3 | 138 | 128 | 134/161 | 58% | 5.5 μm | 1.21 | Yes | 7.2% |

TABLE 1-continued

| | SF-1 | SF-2 | Small diameter SF-2/Large diameter SF-2 | Porosity | Dv | Dv/Dn | Presence of inorganic oxide particle-containing layer | Proportion of toner particles with a circle equivalent diameter of 2 μm or less |
|---|---|---|---|---|---|---|---|---|
| Ex. 4 | 141 | 138 | 144/171 | 59% | 5.8 μm | 1.22 | Yes | 9.4% |
| Compara. Ex. 1 | 123 | 122 | 115/122 | 48% | 6.2 μm | 1.16 | No | 4.2% |
| Compara. Ex. 2 | 175 | 181 | 182/179 | 61% | 5.2 μm | 1.52 | No | 11.4% |

"Small diameter SF-2": toner particles with a particle diameter of less than 4 μm "Large diameter SF-2": toner particles with a particle diameter of 4 μm or greater Note that "particle diameter most abundant in the particle size distribution" is the peak value (4 μm) in the number-based particle size distribution of the toner particles.

It can be learned from Table 1 that the surface factor SF-2 is correlated with the number-based particle diameter.

—Preparation of Developer—

To 3 parts of each of the toners prepared in Examples 1 to 4 and Comparative Examples 1 and 2 was added 97 parts of 100-200 mesh ferrite carrier coated with silicone resin, and mixed together using a ball mill. In this way two-component developers were prepared.

Each developer thus prepared was evaluated for the image uniformity, transfer ratio, occurrence of uneven transfer, and removability.

For each developer, a halftone image was formed using an image forming apparatus (MS2800, manufactured by Ricoh Company, Ltd.) and the degree of surface roughness was visually evaluated based on the following criteria:

A: Excellent (the halftone image surface is very smooth)

B: Good (though not as smooth as A, the halftone image surface is almost free from roughness; no practical problem)

C: Bad the halftone image surface is slightly rough; but still practically acceptable)

D Poor (the halftone image surface is very rough; practically unacceptable)

<Transfer Ratio (%)>

For each developer, a black filled-in image (size=15 cm by 15 cm, average image density=1.38 or more as measured by a Macbeth reflection densitometer) was formed using the image forming apparatus (MS2800, manufactured by Ricoh Company, Ltd.) and its transfer ratio was calculated from the following Equation (3):

$$\text{Transfer ratio (\%)} = (\text{the amount of toner particles transferred to a recording medium/the amount of toner particles developed on a latent electrostatic image bearing member}) \times 100 \quad \text{Equation (3)}$$

<Transfer Unevenness>

For each toner, a black filled-in image was formed using the image forming apparatus (MS2800, manufactured by Ricoh Company, Ltd.) and the occurrence of uneven transfer was visually determined and the unevenness was evaluated based on the following criteria:

A: Excellent (no unevenness)

B: Good (little unevenness; no practical problem)

C: Bad (slight unevenness; still practically acceptable)

D: (much unevenness; practically unacceptable)

<Removability>

The presence of streaky marks on the photoconductor due to cleaning trouble after image formation was visually determined and evaluated based on the following criteria:

A: Excellent (no streaky marks on the photoconductor)

B: Good (one or two very thin, streaky marks that are barely recognized by visual inspection; but no practical problem)

C: Bad (a few streaky marks that can be visually recognized; but practically acceptable)

D: Poor (a number of discrete streaky marks that can be visually recognized; practically unacceptable)

TABLE 2

| | Image uniformity | Transfer ratio (%) | Transfer unevenness | Removability |
|---|---|---|---|---|
| Ex. 1 | A | 87 | B | B |
| Ex. 2 | A | 91 | B | B |
| Ex. 3 | B | 91 | A | A |
| Ex. 4 | B | 92 | A | A |
| Compara. Ex. 1 | C | 91 | C | D |
| Compara. Ex. 2 | D | 78 | D | A |

Figure 9A:
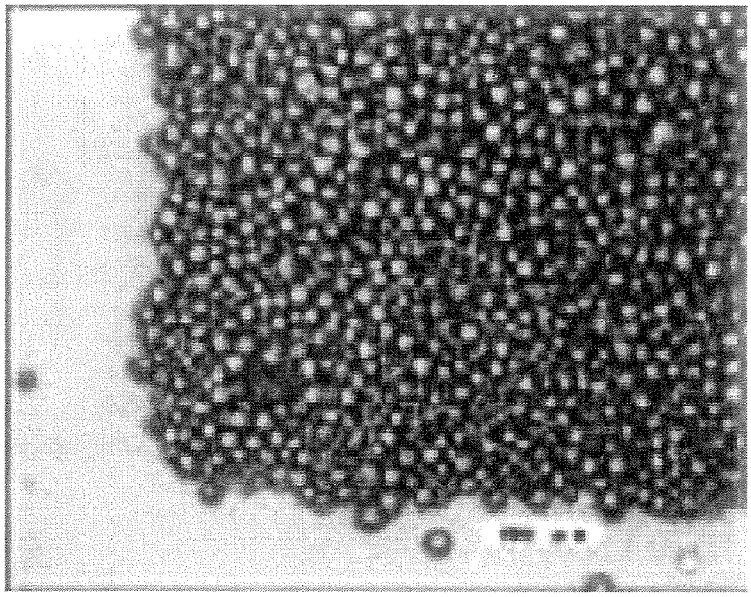
FIG. 9A is a photograph of toner particles in Example 1 accumulated on a latent electrostatic image bearing member.
Figure 9B:
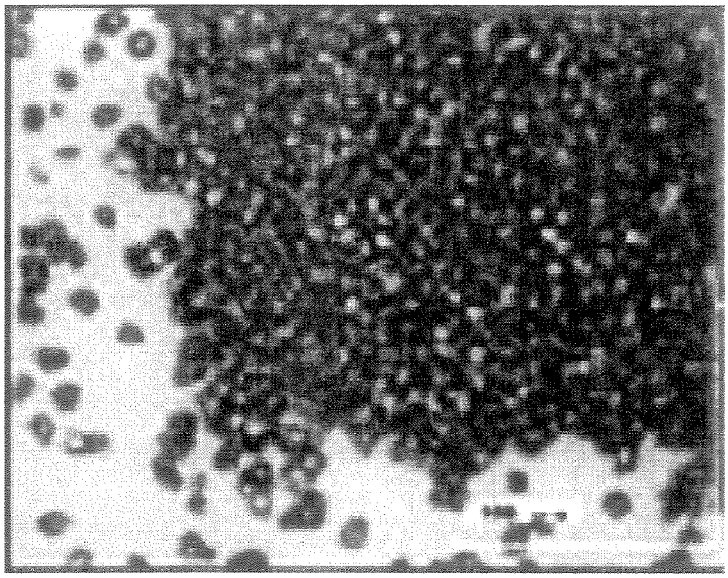
FIG. 9B is a photograph of toner particles in Comparative Example 2 accumulated on a latent electrostatic image bearing member.

FIG. 9A is a picture showing laminated toner particles of Example 1 developed on a photoconductor, and FIG. 9B is a picture showing laminated toner particles of Comparative Example 2 developed on a photoconductor.

As shown in FIG. 9A, the toner particles prepared in Example 1—spherical particles—are not scattered so much and the height of the toner laminate constituting an image is small. The toner particles of Comparative Example 2 shown in FIG. 9B, by contrast, are scattered so much and the height of the toner laminate constituting an image is large. The image densities of the two images in Example 1 and Comparative Example 2 were both 1.3.

The results shown in Table 2 and FIGS. 9A and 9B reveal that toners of Examples 1 to 4 have more excellent image density and removability than toners of Comparative Examples 1 and 2, and feed from transfer unevenness.

The toner of the present invention can provide long term removability and high-definition images with reduced image layer thickness and densely-packed toner particles. Thus, the toner of the present invention can be suitably used for the formation of high-quality images. The developer, toner container, process cartridge, image forming apparatus, and image forming method of the present invention, all of which use the toner of the present invention, can be suitably used for the formation of high-quality images.

What is claimed is:

1. An image forming method comprising:

forming a latent electrostatic image on a latent electrostatic image bearing member;

developing the latent electrostatic image by use of a toner in the form of toner particles to form a visible image;

transferring the visible image to a recording medium; and fixing the transferred visible image to the recording medium, wherein the toner has a substantially spherical shape with irregularities on its surface and comprises a toner material which comprises a binder resin and a colorant, wherein a surface factor SF-1 represented by the following Equation (1) that represents the sphericity of the toner particles is 105 to 180, a surface factor SF-2 represented by the following Equation (2) that represents the degree of surface irregularities of the toner particles for toner particles with a particle diameter of equal to or larger than the most abundant toner particle diameter in a number-based particle size distribution of the toner particles is higher than SF-2 for toner particles with a particle diameter of smaller than the most abundant toner particle diameter in a number-based particle size distribution of the toner particles, and the toner particles have an inorganic oxide particle-containing layer within 1 μm from their surfaces, $$SF\text{-}1=[(MXLNG)^2/\text{AREA}]\times(100\pi/4) \quad \text{Equation (1)}$$

where MXLNG represents the maximum length across a two-dimensional projection of a toner particle, and AREA represents the area of the projection, $$SF\text{-}2=[(PERI)^2/\text{AREA}]\times(100/4\pi) \quad \text{Equation (2)}$$

where PERI represents the perimeter of a two-dimensional projection of a toner particle, and AREA represents the area of the projection.

2. The method according to claim 1, wherein the surface factor SF-2 is such that the difference between the SF-2 of toner particles whose particle diameter is smaller than the most abundant toner particle diameter in a particle size distribution and the SF-2 of toner particles whose particle diameter is equal to or larger than the most abundant toner particle diameter in the particle size distribution is 8 or greater.

3. The method according to claim 1, wherein the SF-1 is 115 to 160 and the SF-2 is 110 to 300.

4. The method according to claim 1, wherein the inorganic oxide particle-containing layer comprises silica.

5. The method according to claim 1, wherein the toner has a volume-average particle diameter of 3 μm to 10 μm.

6. The method according to claim 1, wherein the toner has a ratio of volume-average particle diameter (Dv) to number-average particle diameter (Dn), (Dv/Dn), of 1.00 to 1.35.

7. The method according to claim 1, wherein the proportion of toner particles having a circle equivalent diameter, the diameter of a circle having the same area as the projection of toner particle, of 2 μm is 20% or less on a number basis.

8. The method according to claim 1, wherein the toner particles have a porosity of 60% or less under pressure of 10 $kg/cm^2$.

9. The method according to claim 1, wherein the toner is produced by emulsifying or dispersing a toner material solution or a toner material dispersion in an aqueous medium to form toner particles.

10. The method according to claim 9, wherein the toner material solution or toner material dispersion comprises an organic solvent, and the organic solvent is removed upon or after production of toner particles.

11. The method according to claim 9, wherein the toner material comprises an active hydrogen group-containing compound and a polymer capable of reacting with the active hydrogen group-containing compound, and toner particles are produced by reaction of the active hydrogen group-containing compound with the polymer to produce an adhesive base material which the toner particles comprise.

12. The method according to claim 11, wherein the toner material comprises an unmodified polyester resin and the mass ratio of the polymer capable of reacting with the active hydrogen group-containing compound to the unmodified polyester resin (polymer / unmodified polyester resin) is 5/95 to 80/20.

13. The method according to claim 1, wherein SF-2 for toner particles with a number-average particle diameter of 4 μm or greater, is higher than SF-2 for toner particles with a number-average particle diameter of less than 4 μm.

14. The method according to claim 1, wherein SF-1 is 120 to 150.

15. The method according to claim 14, wherein SF-2 is 118 to 150.

16. The method according to claim 1, wherein SF-2 is 118 to 150.

* * * * *